US010471336B2

(12) United States Patent
Dharma

(10) Patent No.: US 10,471,336 B2
(45) Date of Patent: Nov. 12, 2019

(54) SKATES WITH A STOWABLE AND/OR REMOVABLE ROLLER, BLADE, SKI, OR TRACK ASSEMBLY, AND RELATED METHODS OF USE

(71) Applicant: Dustin Dharma, Edmonton (CA)

(72) Inventor: Dustin Dharma, Edmonton (CA)

( * ) Notice: Subject to any disclaimer, the term of this patent is extended or adjusted under 35 U.S.C. 154(b) by 0 days.

(21) Appl. No.: 15/694,474

(22) Filed: Sep. 1, 2017

(65) Prior Publication Data

US 2018/0065029 A1 Mar. 8, 2018

Related U.S. Application Data

(60) Provisional application No. 62/383,224, filed on Sep. 2, 2016.

(51) Int. Cl.

| | |
|---|---|
| ***A63C 17/20*** | (2006.01) |
| ***A63C 17/00*** | (2006.01) |
| ***A63C 1/30*** | (2006.01) |
| ***A43B 5/16*** | (2006.01) |
| ***A63C 11/16*** | (2006.01) |

(Continued)

(52) U.S. Cl.

CPC ..... *A63C 17/008* (2013.01); *A43B 3/24* (2013.01); *A43B 5/1641* (2013.01); *A43B 5/1691* (2013.01); *A43B 5/18* (2013.01); *A63C 1/303* (2013.01); *A63C 11/16* (2013.01); *A63C 17/20* (2013.01); *A63C 17/06* (2013.01); *A63C 2203/10* (2013.01)

(58) Field of Classification Search

CPC ..... A63C 17/20; A63C 17/008; A63C 17/06; A63C 2017/0053; A63C 1/303; A63C 2203/10; A43B 3/24

See application file for complete search history.

(56) References Cited

U.S. PATENT DOCUMENTS 5,507,506 A 4/1996 Shadroui
5,820,138 A * 10/1998 Hajat Dost Sani .... A63C 17/20 280/7.13

(Continued)

FOREIGN PATENT DOCUMENTS

| | | |
|---|---|---|
| CH | 34817 | 7/1905 |
| DE | 227305 | 10/1910 |

(Continued)

OTHER PUBLICATIONS

Machine translation of EP 3 144 039 (published Mar. 22, 2017); Antonio Vigliotti.*

(Continued)

*Primary Examiner* — Emma K Frick
(74) *Attorney, Agent, or Firm* — Robert A. Nissen

(57) ABSTRACT

A skate with a stowable and/or removable roller, blade, ski, or track assembly. A skate has: a shoe; a guiding part mounted to the shoe; a roller, blade, ski, or track assembly mounted to move along the guiding part between a deployed position and a stowed position adjacent a calf or ankle part of the shoe; and a handle connected to move the roller, blade, ski, or track assembly between the deployed position and the stowed position. Related methods include moving the roller, blade, ski, or track assembly between the positions, and locking or unlocking the assembly in either position, for example using a handle.

17 Claims, 17 Drawing Sheets

(51) Int. Cl.

| | |
|---|---|
| ***A43B 3/24*** | (2006.01) |
| ***A43B 5/18*** | (2006.01) |
| *A63C 17/06* | (2006.01) |

(56) References Cited

U.S. PATENT DOCUMENTS

| | | | | |
|---|---|---|---|---|
| 5,887,898 | A * | 3/1999 | Petrosino | A63C 17/008 280/825 |
| 6,042,125 | A * | 3/2000 | Wu | A63C 17/20 280/11.208 |
| 2003/0127830 | A1 | 7/2003 | Chang et al. | |
| 2003/0132586 | A1 | 7/2003 | Wang | |
| 2003/0155725 | A1 | 8/2003 | Roderick | |
| 2004/0007835 | A1 | 1/2004 | Yang | |
| 2004/0041359 | A1 | 3/2004 | Im | |
| 2004/0066011 | A1 | 4/2004 | Chu et al. | |
| 2008/0290620 | A1 | 11/2008 | Tseng | |
| 2009/0160142 | A1 | 6/2009 | Park | |
| 2014/0116819 | A1 | 5/2014 | Berwanger | |
| 2014/0131146 | A1 | 5/2014 | Bodner | |

FOREIGN PATENT DOCUMENTS

| | | | | |
|---|---|---|---|---|
| DE | 19509246 | | 3/1996 | |
| DE | 19603712 | | 8/1997 | |
| DE | 19603712 | A1 * | 8/1997 | A63C 1/00 |
| DE | 29521594 | U1 * | 10/1997 | A63C 17/18 |
| DE | 29521594 | | 11/1997 | |
| DE | 19801996 | | 7/1999 | |
| DE | 19935242 | | 5/2001 | |
| DE | 10200080 | A1 * | 7/2003 | A63C 17/008 |
| DE | 10311543 | | 9/2004 | |
| DE | 10311543 | A1 * | 9/2004 | A63C 17/006 |
| EP | 3144039 | A1 * | 3/2017 | A43B 5/1608 |
| WO | 2017050698 | | 3/2017 | |

OTHER PUBLICATIONS

Machine translation of DE19603712 obtained from espacenet.com (2 pages).

Hypnoskates (Hypno In-Line Skates), accessed Jun. 21, 2016 online at <<http://www.bossbi.com/boards/hypnoskates/hypnoskates.php>> (4 pages).

Hypnoskates (Hypno In-Line Skates), accessed Aug. 22, 2016 online at <<http://www.bossbi.com/boards/hypnoskates/hypnoskates.php>> (9 pages).

* cited by examiner

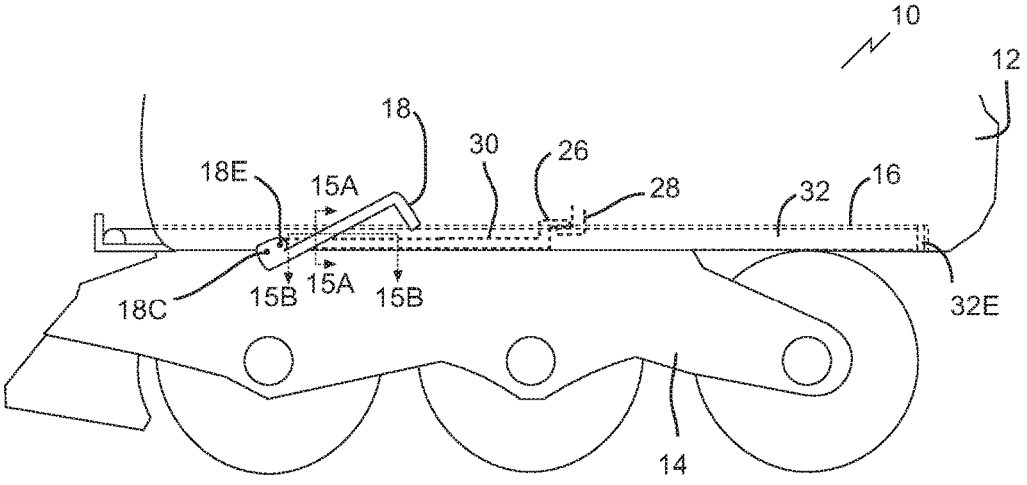
Fig. 15
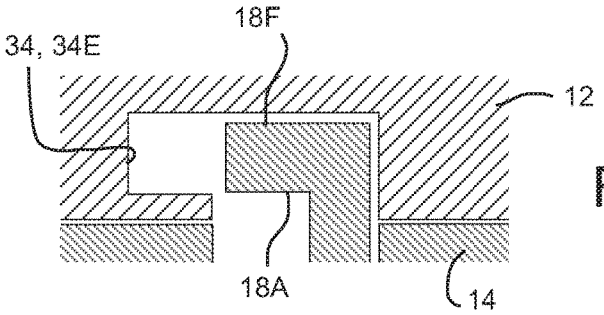
Fig. 15A
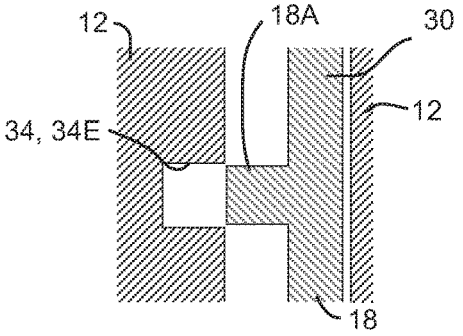
Fig. 15B1
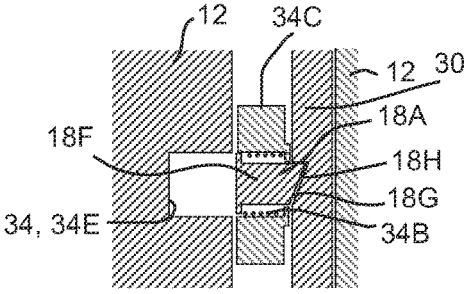
Fig. 15B2

16E
32K
16C
16
32
32K
16C
28A
16A
32E
32F
78A
16H
18A
34
16H
18L
18N
79
14
18E
18M 12
26
78
28
28A
78A
28B
18F
80
30
30C 26
10
38A
38A
12
16A
36A
32
28
27
32K
32I
32I
28A
18
22
36G
32F 14
26
28
27
10
38
12
22
18
29
16F
16G
14
18E
16

29
22
12

28B
18L
18E
14
12
10
36G
22

12C
32
77
32G
14

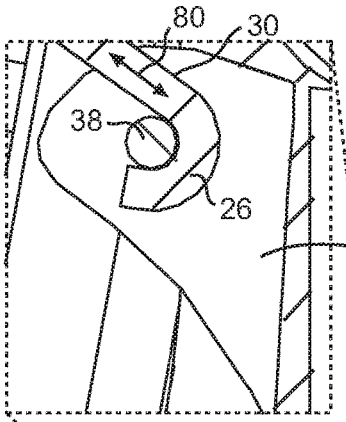
Fig. 35
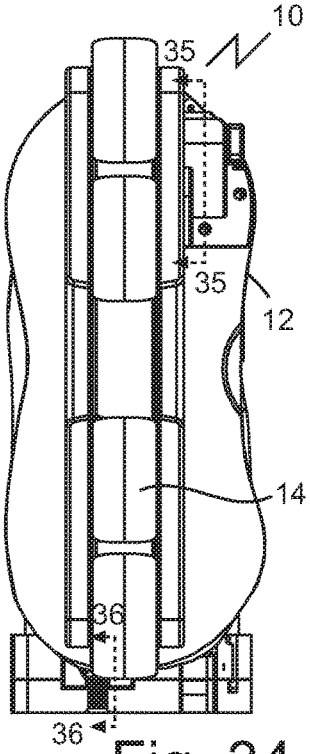
Fig. 34
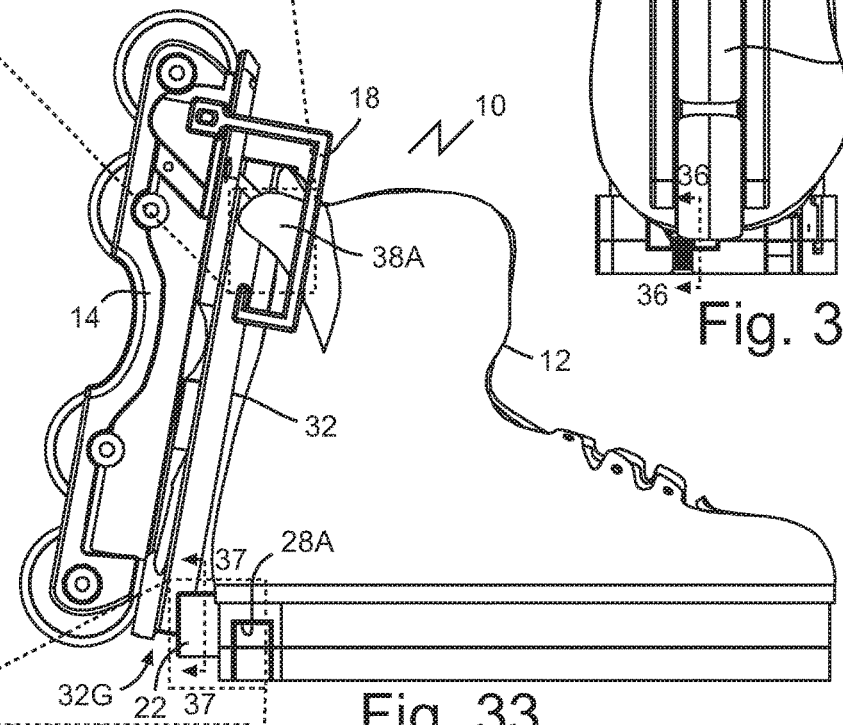
Fig. 33
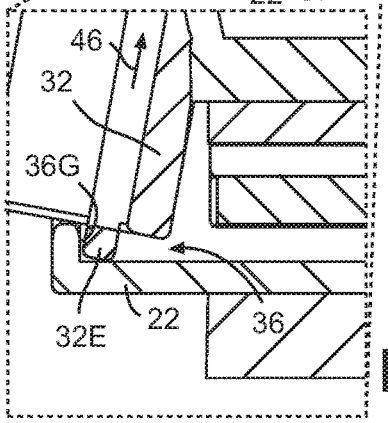
Fig. 36
Fig. 37
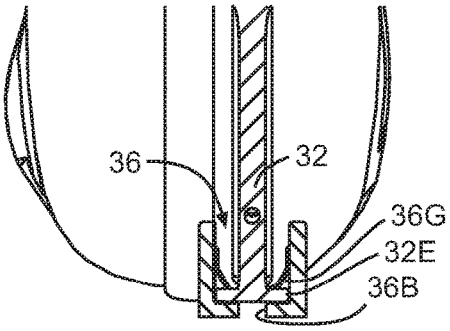

SKATES WITH A STOWABLE AND/OR REMOVABLE ROLLER, BLADE, SKI, OR TRACK ASSEMBLY, AND RELATED METHODS OF USE

TECHNICAL FIELD

This document relates to skates with stowable and/or removable roller, blade, ski, or track assemblies, and related methods of use.

BACKGROUND

Inline skates are known with hinge systems that convert the skates to walking shoes by storing the wheels, blades, ski-boards, or tracks on the back of the shoe.

SUMMARY

A skate, such as a roller skate, with a stowable and/or removable roller assembly is disclosed.

A skate is disclosed comprising: a shoe; a guiding part mounted to the shoe; a roller, blade, ski, or track assembly mounted to move along the guiding part between a deployed position and a stowed position adjacent a calf or ankle part of the shoe; and a handle connected to move the roller, blade, ski, or track assembly between the deployed position and the stowed position.

A method is disclosed comprising: unlocking a roller, blade, ski, or track assembly from a deployed position on a shoe; operating a handle connected to the roller, blade, ski, or track assembly to move the roller, blade, ski, or track assembly along a guiding part into a stowed position adjacent a calf or ankle part of the shoe; and locking the roller, blade, ski, or track assembly to the shoe in the stowed position.

A skate is disclosed comprising: a shoe; a guiding part mounted to the shoe; a roller, blade, ski, or track assembly mounted to move along the guiding part between a deployed position to a stowed position adjacent a calf or ankle part of the shoe; and a lever connected to lock and unlock the roller, blade, ski, or track assembly in the deployed position.

A skate comprising: a shoe; a guiding part mounted to the shoe; a roller, blade, ski, or track assembly mounted to move along the guiding part between a deployed position to a stowed position adjacent a calf or ankle part of the shoe; and a lever connected to lock and unlock the roller, blade, ski, or track assembly in the stowed position.

A method of interconverting a roller, blade, ski, or track skate between an operating position and a stowed position is disclosed comprising: unlocking a roller, blade, ski, or track assembly from an operating position where the roller, blade, ski, or track assembly is secured to the sole of a shoe; sliding the roller, blade, ski, or track assembly in a horizontal rearward direction along a guide mounted to the sole until the roller, blade, ski, or track assembly extends rearward past the heel of the shoe; pivoting the roller, blade, ski, or track assembly upward, about a hinge connection between the roller, blade, ski, or track assembly and the sole, until the roller, blade, ski, or track assembly is in a stowed vertical position adjacent an ankle part of the shoe; locking the roller, blade, ski, or track assembly to the ankle part of the shoe; and converting the roller, blade, ski, or track skate back into the operating position by a reverse of the above procedure. In some cases one or more of the following may be achieved: unlocking is achieved by rotating a lever handle, which is located on a rear part of the roller, blade, ski, or track assembly; sliding is achieved by the user pulling on the handle to slide the roller, blade, ski, or track assembly rearward; pivoting is achieved by the user pulling upward on the handle to pivot the roller, blade, ski, or track assembly into the stowed vertical position; and locking is achieved by rotating the lever handle. From the stowed vertical position, the lever handle may be operated to detach the roller, blade, ski, or track assembly entirely from the shoe.

In various embodiments, there may be included any one or more of the following features: The handle is located at or near a rear end of the roller, blade, ski, or track assembly. The handle forms a lever that is connected to lock and unlock the roller, blade, ski, or track assembly in the deployed position. The lever is connected to pivot relative to the roller, blade, ski, or track assembly to lock and unlock the roller, blade, ski, or track assembly in the deployed position. The lever is connected to actuate a locking part that engages and disengages a locking part receiver of the guiding part to lock and unlock, respectively, the roller, blade, ski, or track assembly in the deployed position. The locking part comprises a plurality of hooks. The locking part is actuated by a drive bar that is connected to the lever on the roller, blade, ski, or track assembly. The lever and locking part form a camlock. The lever is located adjacent a side of the shoe. The lever is connected to actuate the locking part when the lever is swung toward or away from a front of the shoe. The lever is connected to actuate a lever lock, between the lever and one or both of the roller, blade, ski, or track assembly and shoe, by translating the lever toward or away from the side of the shoe. The lever lock is formed by cooperating male and female parts on the shoe and the roller, blade, ski, or track assembly. The lever is connected to actuate the locking part to engage and disengage a locking part receiver of the calf or ankle part of the shoe to lock and unlock, respectively, the roller, blade, ski, or track assembly in the stowed position. The handle forms a lever that is connected to lock and unlock the roller, blade, ski, or track assembly in the stowed position. The guiding part comprises a hinge located at a rear end of the shoe. The roller, blade, ski, or track assembly is mounted to, in sequence: swing downward about the hinge, relative to the shoe, from the deployed position; and slide upward along the guiding part, relative to the shoe, along the calf or ankle part of the shoe into the stowed position. The roller, blade, ski, or track assembly is mounted to, in sequence: slide rearward along the guiding part, relative to the shoe, from the deployed position; and swing upward about the hinge, relative to the shoe, into the stowed position. The hinge forms a socket that during use seats a pivot part of the roller, blade, ski, or track assembly. The pivot part is on a rail bar of the roller, blade, ski, or track assembly. The hinge defines a guide channel through which slides a part, of the roller, blade, ski, or track assembly, for example a rail bar of the roller, blade, ski, or track assembly. The rail bar fits within a slot in an under surface of the guiding part when the roller, blade, ski, or track assembly is in the deployed position. The hinge is retractable. The guiding part is structured to permit the roller, blade, ski, or track assembly to be removed. The skate forming an inline skate. The roller, blade, ski, or track assembly and guiding part form a unit that is structured to retrofit to the shoe. Unlocking the roller, blade, ski, or track assembly from the deployed position is accomplished using the handle. Locking the roller, blade, ski, or track assembly in the stowed position is accomplished using the handle. The handle comprises a lever pivotally mounted to the roller, blade, ski, or track assembly. Unlocking the roller, blade, ski, or track assembly from the stowed position; operating the handle to move the roller, blade, ski, or track assembly along the guiding part into the deployed position; and locking the roller, blade, ski, or track assembly to the shoe in the deployed position. Unlocking the roller, blade, ski, or track assembly from the stowed position is accomplished using the handle. Locking the roller, blade, ski, or track assembly in the deployed position is accomplished using the handle. The skate forms a roller skate.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIG. 15 is a side elevation view of another embodiment of a roller skate.

FIGS. 15A and 15B1 are section views taken along section lines 15A and 15B, respectively, of FIG. 15, and illustrating an example of a locking mechanism.

FIG. 15B2 is a section view taken along section lines 15B of FIG. 15, illustrating another example of a locking mechanism.

FIG. 33 is a side elevation view of the roller skate of FIG. 24 illustrating the roller assembly locked in the stowed position.

FIG. 34 is a rear end view of the roller skate of FIG. 33.

FIG. 35 is a section view taken along the 35-35 section lines of FIG. 34 and illustrating the area shown in dashed lines in FIG. 33.

FIG. 36 is a section view taken along the 36-36 section lines of FIG. 34 and illustrating the area shown in dashed lines in FIG. 33.

FIG. 37 is a section view taken along the 37-37 section lines of FIG. 33.

DETAILED DESCRIPTION

Immaterial modifications may be made to the embodiments described here without departing from what is covered by the claims.

Skating is a recreational activity, sport, and mode of transportation, and involves moving over a surface while gliding on rollers, blades, skis, or tracks. Roller skates come in at least three varieties: classic quad roller skates, inline skates or blades and tri-skates. Classic roller skates are shoes, or bindings that fit onto shoes, and that are worn to enable the wearer to roll along on wheels. The quad style of roller skate consists of four wheels arranged in the same configuration as the wheels of a typical car. Roller skates are used in a variety of sports, such as roller derby, speed skating, roller hockey, freeline skating, freestyle slalom skating, and downhill roller skating Inline roller skates are a recent adaptation of the classical roller skate. Inline skates may comprise a generally rigid shoe or boot portion. A set of at least two, but preferably three or four or more, rubber or hard plastic wheels are rotatably fixed to a support frame or chassis, and the frame is in turn fixed to the bottom of the shoe. The wheels of an inline skate are set radially along an axis from the front to the back of the shoe. When skates are used as part of a multi-mode activity, a user is required to bring with him or her other appropriate footwear for the parts of the activity that do not involve skates. For example, if a user embarks on a trip that involves skating and walking, running, and/or hiking, he or she must carry an extra pair of shoes to replace the skates as needed, and vice versa. The user may also be required to carry the skates when not in use.

Figure 1:
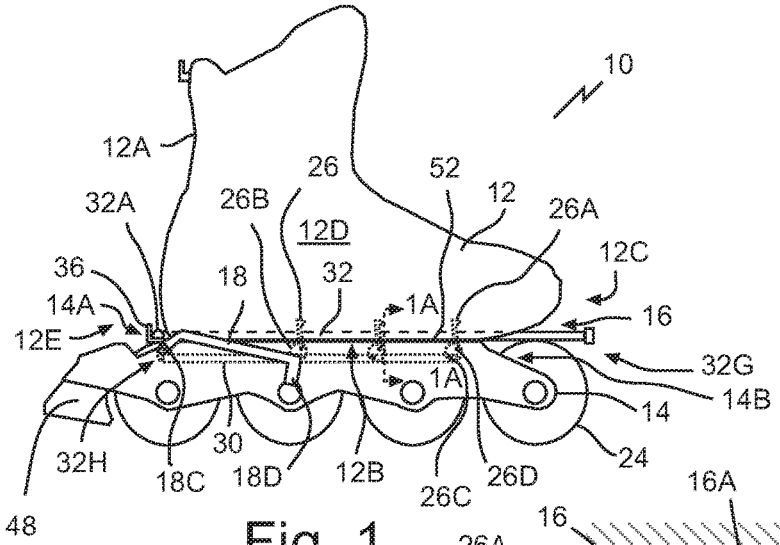
FIG. 1 is a side elevation view of a roller skate with a roller assembly locked in the deployed position, and configured to move between the deployed position and a stowed position via a swing and slide maneuver.
Figure 1A:
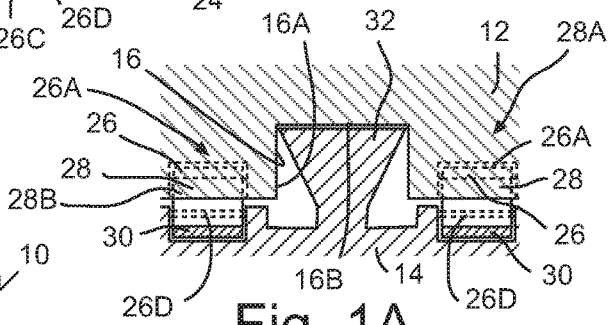
FIG. 1A is a section view taken along the section lines 1A of FIG. 1.
Figure 6:
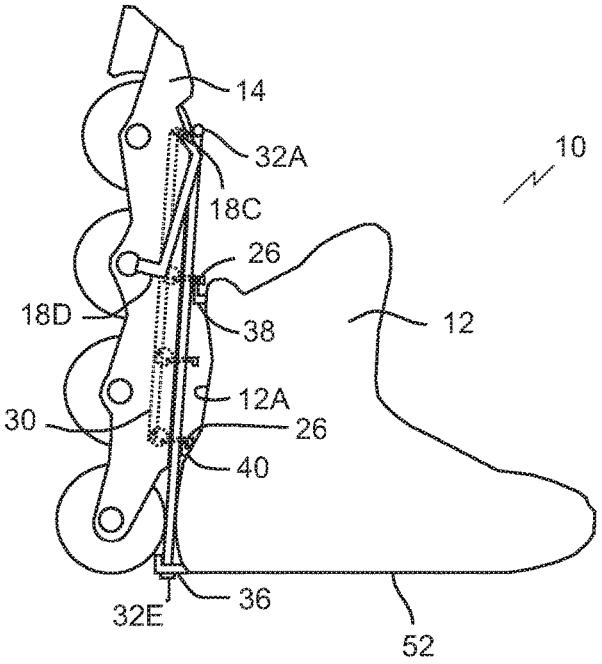
FIG. 6 is a side elevation view of the roller skate of FIG. 1 illustrating the roller assembly locked in the stowed position.
Figure 18:
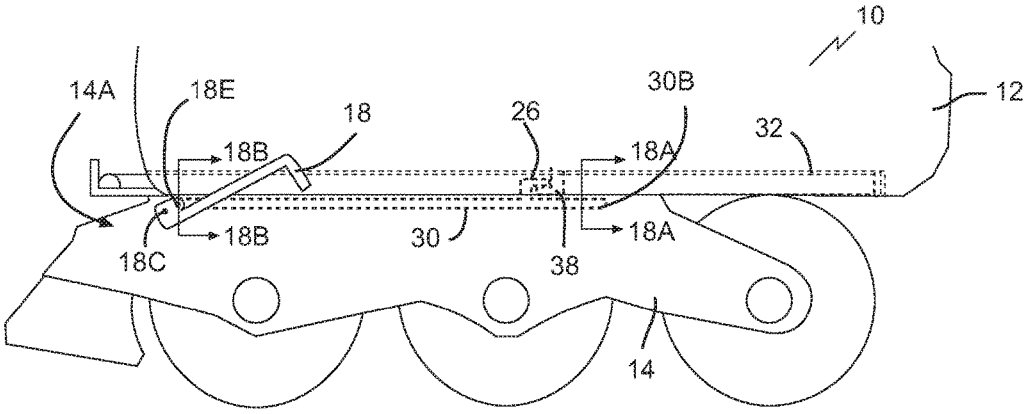
FIG. 18 is a side elevation view of another embodiment of a roller skate illustrating the roller assembly locked in the deployed position.

Referring to FIGS. 1, 1A, and 6, a roller skate 10, such as an inline skate, is disclosed comprising a shoe 12, a roller assembly 14 and a handle 18. A guiding part 16 is mounted to the shoe 12 and the roller assembly 14 is mounted to move along the guiding part 16. The roller assembly 14 moves, for example along the guiding part 16, between a deployed position (FIG. 1) and a stowed position (FIG. 6). In the deployed position, the roller assembly 14 may underlie a sole 12B of the shoe 12, sole 12B being a substantially flat or other appropriate surface for ground engaging contact while walking with the roller assembly 14 in the stowed position. In the stowed position the assembly 14 may be adjacent, for example rearward of, a calf or ankle part 12A of the shoe 12. Thus, when the roller assembly 14 in the stowed position the user may operate roller skate 10 as a walking shoe, permitting the user to avoid having to change into alternate footwear if walking is desired. Referring to FIG. 18, roller assembly 14 may comprise a suitable number of rollers 24, and a stop or brake 48 on the heel or toe part of the skate 10.

Referring to FIGS. 1 and 6, examples of deployed and stowed positions are depicted. A deployed position may include a position in which the roller assembly 14 is located beneath the sole 12B of shoe 12. While locked in the deployed position the roller skate facilitates skate 10 to be safely used as a roller skate. The deployed position includes positions in which roller assembly 14 is below a longitudinal plane 52 defined by sole 12B, and rollers 24 are below the sole 12B and when locked are arranged to support and balance the weight of a user wearing the roller skate 10. The stowed position may include a position in which the roller assembly 14 is above plane 52, and in some cases where the assembly 14 is located adjacent or against a calf or ankle part of the user or shoe.

Referring to FIGS. 1 and 6, the handle 18 may be used for a variety of functions during the use of roller skate 10. For example, the handle 18 may be operated to one or more of a) lock and unlock the assembly 14 while in the deployed position, b) move the assembly 14 between the deployed and stowed positions, and c) lock and unlock the assembly 14 when in the stowed position. Each position permits a particular use of the apparatus. While the roller assembly 14 is locked in the deployed position, roller skate 10 may be used for transportation and recreation. Once in the stowed position, the roller assembly 14 may be locked to the shoe to permit walking. Handle 18 may be configured to actuate all locking and unlocking steps, as well as to guide assembly 14. The use of a single handle 18 for all steps may increase the ease of operation of roller skate 10, particularly if the methods are carried out while the shoe 12 is being worn by the user.

Referring to FIGS. 1 and 6, from the stowed position the user may move assembly 14 back into the deployed position to permit roller skating, for example by using a deployment procedure that is the reverse of the stowing procedure. First, the user may unlock the roller assembly 14 from the calf or heel part 12A of shoe 12. Roller assembly 14 may be then moved along the guiding part 16 to the deployed position by operating handle 18. The roller assembly 14 may be locked into the deployed position and skate 10 may be used as a roller skate.

Figure 2:
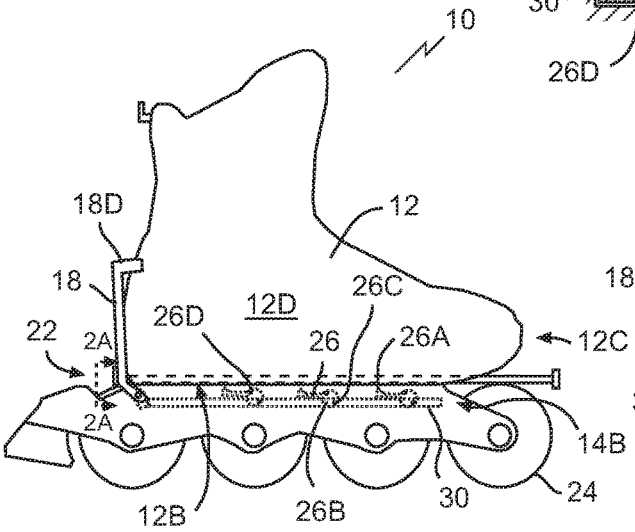
FIG. 2 is a side elevation view of the roller skate of FIG. 1 illustrating the roller assembly unlocked and in the deployed position.

Referring to FIGS. 1 and 2, handle 18 may be structured and positioned in a suitable fashion for operation. Handle 18 may be located on the roller assembly 14 in a suitable location for operation by a user, such as at or near a rear end 14A. Handle 18 may be located adjacent, for example along, a side 12D of the shoe 12 and/or roller assembly 14. Handle 18 may be pivotally connected to the roller assembly or rigidly fixed. Handle 18 may be fastened in a pivotal connection to assembly 14 via a suitable axle 18C. In cases where handle 18 is pivotally connected to assembly 14, handle 18 may be structured to carry out a variety of, including plural, axes of movement. For example, handle 18 may be mounted to pivot about an axis parallel or perpendicular to the axes of rollers 24. Handle 18 may be shaped to receive a user's hand by, for example, with one or both of a hooked or flanged end 18D, finger grooves (not pictured), or other structure defining a finger receiving recess or part.

Referring to FIGS. 1 and 2, assembly 14 may be locked and unlocked to the shoe and/or guiding part 16 when in the deployed position, for example using handle 18. While in the deployed position, handle 18 may form a lever that pivots relative to the roller assembly 14 to lock or unlock the assembly 14 to the shoe 12. Handle 18 may actuate a locking part, such as a hook 26, to lock and unlock assembly 14 to shoe 12 while in the deployed position. Handle 18 may rotate the lever toward or away from a front end 12C of the shoe 12 to actuate hook 26. Referring to FIGS. 1, 1A, and 2, hook 26 may engage a corresponding locking part receiver, such as a hook receiving part 28, of the guiding part, when actuated by the lever. Hook receiving part 28 may comprise a cavity 28A with a part 28B, such as a shelf as shown, for receiving a hook end 26A of hook 26, with part 28B engaging the bottom part of hook end 26A. Hook 26 may comprise a plurality of locking parts such as hooks 26 that engage with the guiding part at multiple points along sole 12B to secure assembly 14 to shoe 12. Hook receiving part 28 may comprise a plurality of hook receiving parts 28 for engaging with the plurality of respective hooks 26. Other suitable locking parts may be used, such as loops or rings that swing into and out of engagement with a corresponding hook, pin, or shelf.

Referring to FIGS. 1 and 2, the locking part or hooks 26 may be actuated by a drive bar 30 that is operated by the handle 18. Drive bar 30 may be pivotally mounted to handle 18, for example by rack and pinion or by pivot axle to extend and retract along an axis. Hooks 26 may be pivotally mounted on drive bar 30. For example, hook 26 may define body drive bar and roller assembly pivot axles 26C and 26D, respectively, with pivot axle 26C connecting hook body 26B to drive bar 30 and axle 26D connecting to the roller assembly 14. Drive bar 30 may be configured to move, for example translate, toward and away from a front part 14B of the assembly 14 by rotation of handle 18. The hook 26 may prevent the assembly 14 from sliding toward the front end 12C of the shoe 12. In some embodiments, the drive bar and hooks are connected via a rack and pinion mechanism. Hooks 26 and handle 18 may be connected by suitable mechanisms, such as a chain and sprocket, pulley, cable, band or a plurality or combination of the above elements.

Figure 2A:
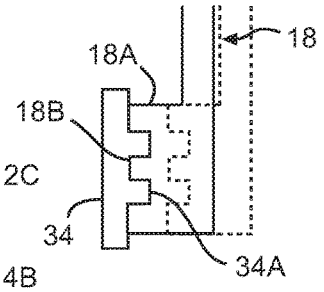
FIG. 2A is a side elevation view of a lever lock used to lock the lever of the roller skate in the position shown in FIG. 1.

Referring to FIG. 2A, handle 18 may lock in position to prevent movement, for example to incorporate a lever lock. Handle 18 may lock to the roller assembly 14 or guiding part 16 to stop unwanted rotation and therefore unlocking or locking of assembly 14 during operation of roller skate 10. Handle 18 may actuate a lever lock 18A, or the lock may be actuated by other mechanism, and the lever lock 18A may lock the lever to one or both of the roller assembly 14 and shoe 12. The lock 18A may be operated by translating the lever/handle 18 toward (shown in solid lines) or away (shown in dashed lines) from the side of the shoe 12, for example along an axis that is perpendicular to a plane defined by the swinging motion of the lever. Lock 18A may be formed by cooperating male and female parts, for example teeth 18B on the lever that engages with teeth 34A on opposing lock part 34, of the roller assembly 14 in this case. Lock part 34 may be mounted on a fixed point of skate 10 relative to the lever, such as on the roller assembly 14 or shoe 12. When teeth 18B and 34A are engaged, handle 18 may be fixed from movement, for example other than to reverse the lever lock. When handle 18 is pulled away from the shoe, teeth 18B may come out of engagement with teeth 34A, and handle 18 may rotate freely and actuate bar 30. In some cases, lever lock 18A comprises a female or male part on handle 18 and a cooperating male or female part on the fixed point.

Figure 3:
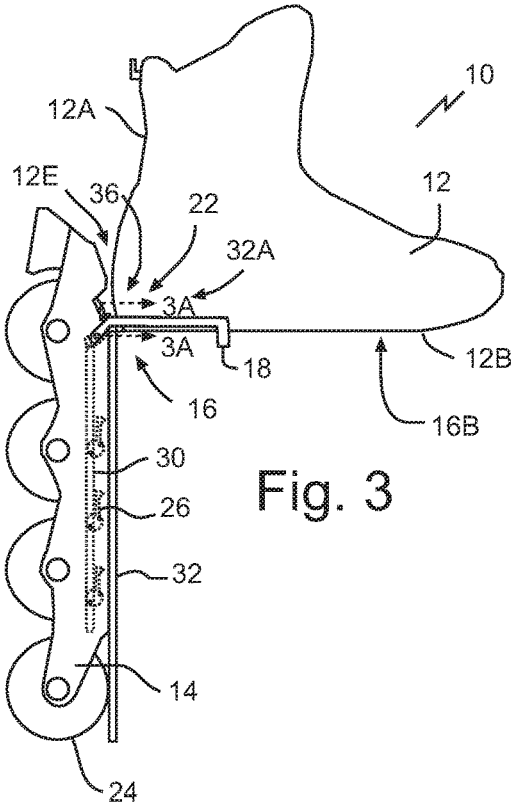
FIG. 3 is a side elevation view of the roller skate of FIG. 1 illustrating the roller assembly at an intermediate position between the deployed and stowed positions.
Figure 5:
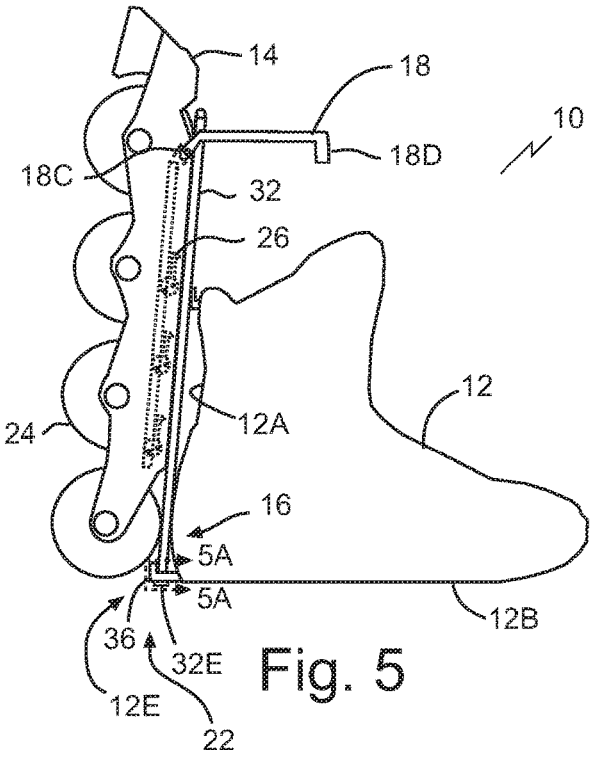
FIG. 5 is a side elevation view of the roller skate of FIG. 1 illustrating the roller assembly unlocked and in the stowed position.

Referring to FIGS. 1 and 5, handle 18, roller assembly 14, and guiding part 16 may be structured to permit the handle 18 to be used to move roller assembly 14 between a deployed and a stowed position. Movement may include moving the handle 18 through a single or a variety of types of motions, for example pulling, and/or pushing motions, to transition the assembly 14 between positions. Several examples of suitable patterns of motion include mechanisms that involve a) swinging the roller assembly 14 downward and sliding the assembly 14 upward along the rear of the shoe 12, and b) sliding the roller assembly 14 rearward and swinging the assembly 14 upward against the rear of the shoe 12. Other paths and patterns of motion may be used. The pattern of movement of handle 18 to move the assembly 14 may be combined with motions to lock and unlock the assembly 14 in either or both the deployed and stowed positions. For example, referring to FIGS. 1 and 2 a user may pull on handle 18 in the deployed position to unlock the assembly 14 by rotating hooks 26 from a locked to an unlock configuration. The assembly 14 may then be moved to the stowed position with the same pulling action. Referring to FIGS. 2-3 and 5 an upward pulling force on the handle 18 may be used to draw the assembly 14 into the stowed position.

Referring to FIGS. 1, 3 and 5, roller assembly 14 may move between a deployed and stowed position via a swing-and-slide pattern of motion. Assembly 14 may in sequence swing downward (FIG. 3) from the deployed position and slide upward to the stowed position (FIG. 5). Guiding part 16 may comprise a hinge 22 that defines a pivot point or path for the swinging motion of assembly 14. Hinge 22 may be located at or near a rear end 12E of the shoe 12. Hinge 22 may permit single axis or multi-axis swinging movement. An example of single axis movement may be achieved with a socket and ball mechanism. An example of multi axis movement may be achieved by a curved slot (not shown) in guiding part 16 that permits assembly 14 to slide and pivot as assembly 14 travels from the sole 12B to the calf or heel part 12A.

Figure 3A:
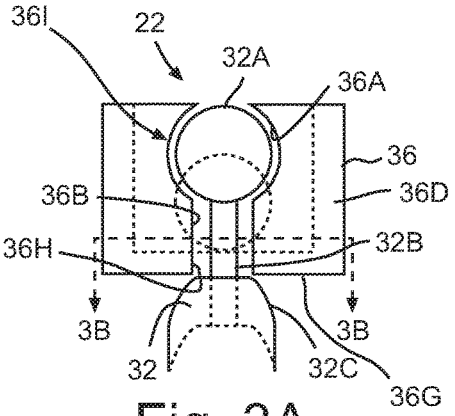
FIG. 3A is a section view taken along the section lines 3A of FIG. 3.
Figure 3B:
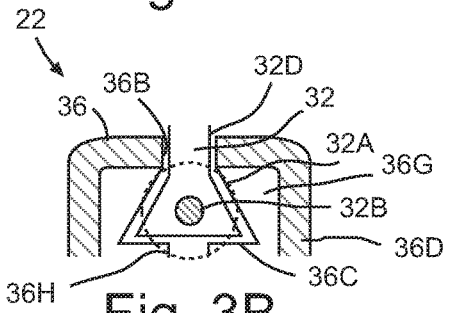
FIG. 3B is a section view taken along the section lines 3B of FIG. 3A.
Figure 11:
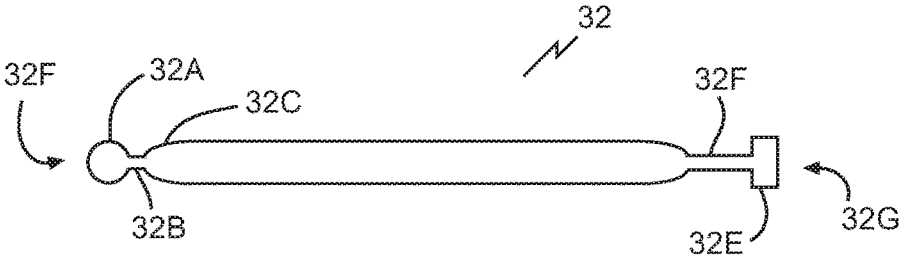
FIG. 11 is a top plan view of an embodiment of a rail bar of the roller assembly from the roller skate of FIG. 7.

Referring to FIG. 3, the hinge 22 and a pivot part 32A of assembly 14 may cooperate to permit the swinging motion. Hinge 22 may form a socket 36, which may seat a pivot part 32A, such as a ball, cylinder, or other part, of the assembly 14. Referring to FIGS. 3A and 3B, socket 36 may be formed by side walls 36D and base walls 36G that retain the pivot part 32A in the socket 36. Pivot part 32A may be a suitable hinge, pin, bushing or a device that permits single or multi-axis motion. Referring to FIGS. 3, 3A and 3B, pivot part 32A may be mounted to roller assembly 14 in a suitable fashion. In some cases, pivot part 32A is mounted on a rail bar 32. Bar 32 may extend parallel to a longitudinal axis of roller assembly 14, in some cases along the entire longitudinal length of the assembly 14. Assembly 14 may connect to rail bar 32 via a base neck 32D, that is shaped to fit within a base slot 36H defined by the base walls 36G of socket 36. Referring to FIG. 11, rail bar 32 may define a neck 32B mounting pivot part 32A to rail bar 32. Referring to FIGS. 3A and 3B, neck 32B may be shaped to fit within slot 36H to permit the rail bar 32 to swing about the pivot part 32A while the part 32A is seated within socket 36. Socket 36 and/or pivot part 32A, and/or other parts of the skate 10 may comprise a dampening material, such as cloth or rubber or plastic to dampen any clacking, grinding, or other sounds created by contact between moving parts, for example metal hitting concrete or ceramics.

Figure 5A:
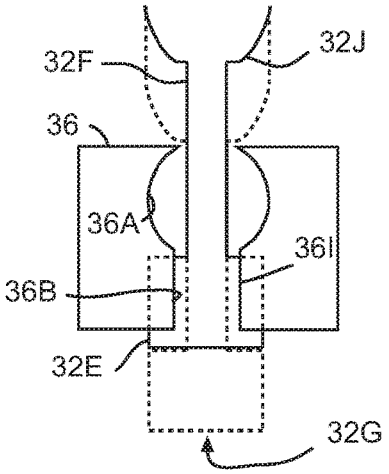
FIG. 5A is an end plan view of a socket of the roller skate of FIG. 5.

Referring to FIGS. 3A, and 3B, rail bar 32 may be adapted to slide along the guiding part, for example through a guide channel 36C defined by base walls 36G of socket 36. A rear vertical slot 36I may be defined in side walls 36D to facilitate sliding passage of neck 32D of rail bar 32. Referring to FIG. 3B, guide channel 36C and rail bar 32 may have complimentary cross-sectional shapes, for example different-sized trapezoids, with the channel 36C structured to provide sufficient clearance to permit free sliding of rail bar 32 through channel 36C. Referring to FIGS. 3A and 5A, leading and trailing shoulders 32C and 32J of rail bar 32 may be tapered to facilitate entry of rail bar 32 into guide channel 36C from either directions. In some cases (not shown), pivot part 32A and rail bar 32 are independent parts. In some cases the hinge 22 is independent from the guide channel 36C. Referring to FIGS. 3A and 3B, guide channel 36C may be structured to prevent pivot part 32A from passing through, and/or slot 36I may be structured to prevent rail bar 32 from laterally passing through, in order to retain such parts within socket 36 in use. Referring to FIGS. 5 and 5A, rail bar 32 may comprise a flange or other stop 32E. Stop 32E may be located at a front end 32G of rail bar 32. As rail bar 32 slides along guide channel 36C into the stowed position, stop 32E engages with socket 36 to prevent additional sliding.

Referring to FIG. 1A, rail bar 32 may fit into guiding part 16 when roller assembly 14 is in the deployed position. Guiding part 16 may comprise a slot 16A in an under surface 16B shaped to fit rail bar 32. Slot 16A may be structured to permit the rail bar 32 to swing about hinge 22 to enter and exit the slot 16A by such action. Slot 16A may be sized with sufficiently limited lateral dimensions to permit walking on sole 12B while the skate 10 is in the stowed configuration. The guiding part 16 may incorporate one or more rails that mate with or insert into corresponding grooves or slots within roller assembly 14.

Referring to FIGS. 5 and 6, assembly 14 may be locked and unlocked to shoe 12 and/or guiding part 16 in the stowed position, for example by operation of handle 18. Handle 18 may actuate a locking part, such as hook 26, to engage and disengage a corresponding locking part receiver, such as hook receiving part 38, connected to the calf or ankle part 12A. Handle 18 may provide a single part for the user to lock and unlock assembly 14 when deployed, move assembly 14 from the deployed to the stowed position and lock and unlock assembly 14 in the stowed position. While assembly 14 is locked in the stowed position, hook receiving part 38 and rail stop 32E may cooperate to prevent axial removal of assembly 14 from the roller skate 10. Hook receiving part 38 may comprise a plurality of parts 38 and 40 that cooperate with plural hooks 26 to provide plural points of contact between assembly 14 and shoe 12.

Figure 4:
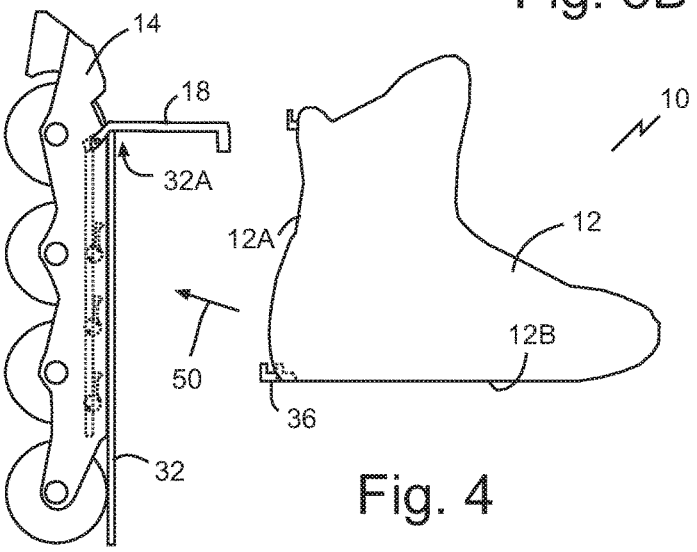
FIG. 4 is a side elevation view of the roller skate of FIG. 1 illustrating the roller assembly 14 being removed from the shoe.

Referring to FIGS. 3A, 3B, 4, 5, and 5A, guiding part 16 may be structured to permit roller assembly 14 to be removed entirely from roller skate 10 at one or more suitable positions in the range of positions of assembly 14 relative to guiding part 16. Referring to FIGS. 3A, 3B, and 4, removal between the swinging and sliding step is shown. Referring to FIG. 3A, retaining walls 36D may define a slot 36I with a first section 36B and second section 36A. The first section 36B may be shaped to permit passage of neck 32D of rail bar 32 but prevent passage of pivot part 32A when the bar 32 is in the position shown in dashed lines, while the second section 36A may be structured to permit pivot part 32A to pass when bar 32 is in the position shown in solid lines. Referring to FIGS. 3A and 4, roller assembly 14 may thus be removed by lifting the assembly 14 into the position shown in dashed lines and pulling the assembly 14 in a rearward direction 50.

Referring to FIGS. 5 and 5A, assembly 14 may be removed from shoe 12 while in or near the stowed position. Rail bar 32 may comprise an axial neck 32F at a front end 32G of bar 32 between stop 32E and a trailing shoulder 32J of rail bar 32. Neck 32F may be shaped to pass through slot 36I defined by retaining walls 36D when at the position shown in dashed lines. Referring to FIG. 5A, assembly 14 may be lowered from the stowed position (solid lines) until neck 32F and sections 36A and 36B are aligned (dashed lines). Assembly 14 may be then pulled away from shoe 12 in a rearward direction to remove assembly 14 entirely from skate 10. Removal from other positions may be used, for example removal from within or near the deployed position.

Referring to FIG. 4, hinge 22 may be adapted to be minimized, removed, or retracted, for example after roller assembly 14 is removed. Hinge 22 may retract into shoe 12 by sliding forward into a slot within the shoe or guiding part 16. Such action may increase the utility of shoe 12 as a walking shoe. The hinge or hook may flip up or be removable in some cases.

Figure 7:
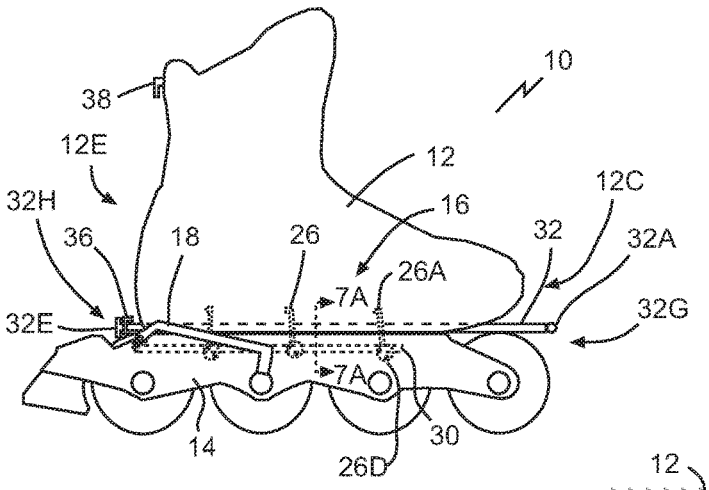
FIG. 7 is a side elevation view of another embodiment of a roller skate with a roller assembly adapted for a slide-and-swing motion locked in a deployed position.
Figure 9:
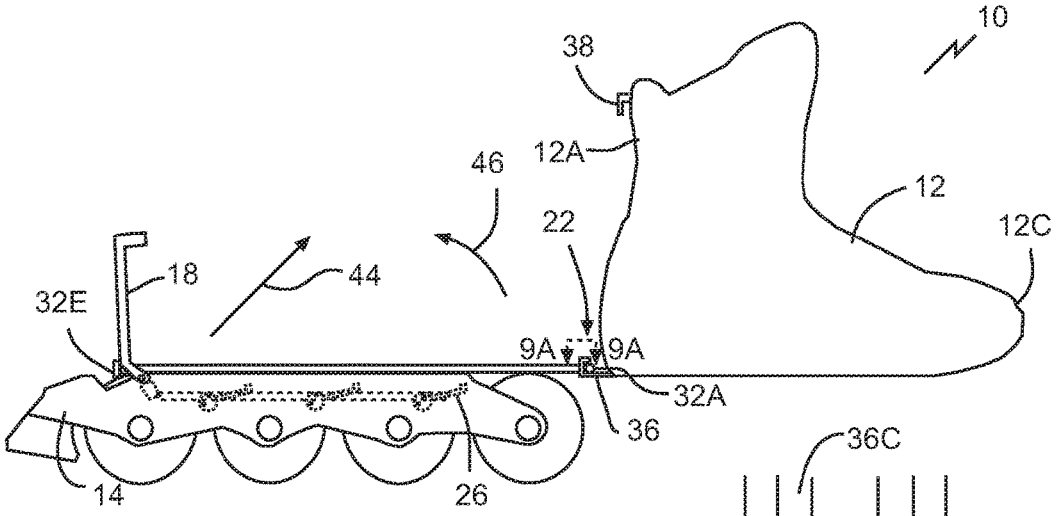
FIG. 9 is a side elevation view of the roller skate of FIG. 7 illustrating the roller assembly at an intermediate position after sliding rearward along a guiding part.
Figure 10:
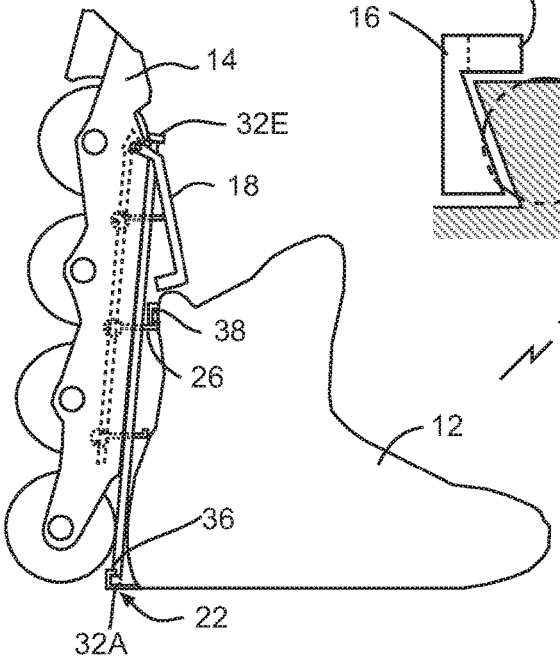
FIG. 10 is a side elevation view of the roller skate of FIG. 7 illustrating the roller assembly locked in a stowed position.

Referring to FIGS. 7, 9 and 10, an embodiment of skate 10 is illustrated that permits assembly 14 to move from a deployed to a stowed position by a slide-and-swing motion. Roller assembly 14 may be mounted to slide rearward along guiding part 16 from the deployed position (FIG. 9). Rail bar 32 may engage with hinge 22 at the end of retainer guiding part 16. Assembly 14 may then swing upward about hinge 22 into the stowed position (FIG. 10). The slide-and-swing motion may be accomplished by operating handle 18. The assembly 14 may be locked and unlocked when in the stowed and/or deployed positions, in some cases using the handle 18.

Figure 7A:
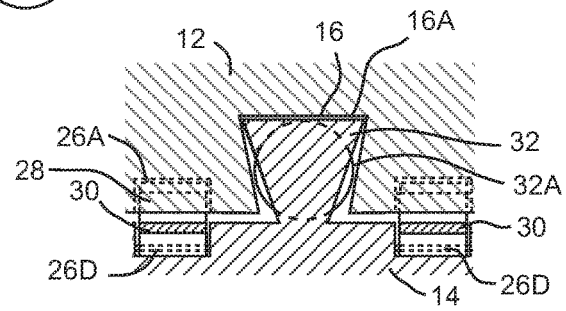
FIG. 7A is a section view taken along the section lines 7A of FIG. 7.
Figure 8:
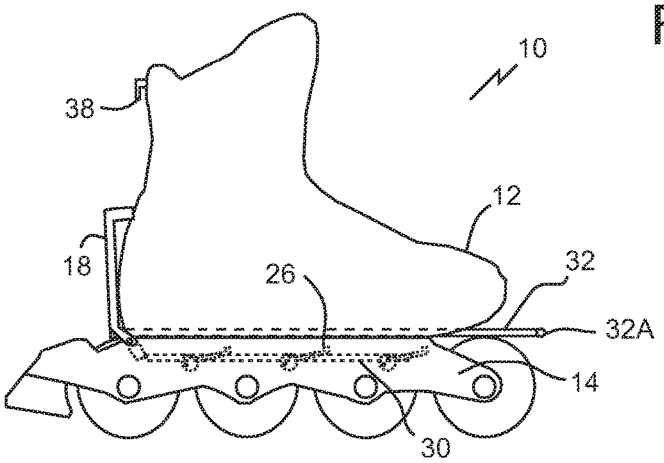
FIG. 8 is a side elevation view of the roller skate of FIG. 7 illustrating the roller assembly unlocked in the deployed position.

Referring to FIGS. 7 and 8, rotation of the handle 18 toward and away from the front end 12C of the shoe 12 acts to lock and unlock the assembly 14, respectively. Hooks 26 may be adapted to prevent sliding while assembly 14 is locked to shoe 12. Hook end 26A may face the rear end 12E of shoe 12 and may prevent sliding of roller assembly 14 towards end 12E when locked. Rail bar 32 may comprise stop 32E connected at the rear end 32H of bar 32. Stop 32E may prevent sliding of assembly 14 towards front end 12C while the assembly 14 is locked. Pivot axles 26D may be positioned below drive bar 30 to actuate hooks 26 to engage hook receiving parts 28 (FIG. 7A).

Referring to FIGS. 7 and 7A, rail bar 32 and guiding part 16 may be configured in a suitable fashion for slide-and-swing motion. Bar 32 may mount pivot part 32A at the front end 32G of bar 32. Bar 32 may slide along guiding part 16 until front end 32G and pivot part 32A come into engagement with socket 36 to form hinge 22. Assembly 14 may then swing towards the calf part 12A to the stowed position. Referring to FIG. 7A, guiding part 16 may define a slot 16A that is shaped to retain rail bar 32 and pivot part 32A within slot 16A, to prevent rail bar 32 from being removed from slot 16A in a direction perpendicular to an axis of slide through the slot 16A. Referring to FIG. 9B, guiding part 16, in this case hinge 22, may define guide channel 36C in socket 36.

Figure 9A:
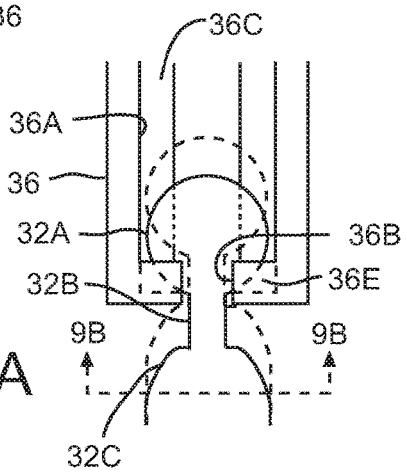
FIG. 9A is a top plan view taken along the view lines 9A of FIG. 9.
Figure 9B:
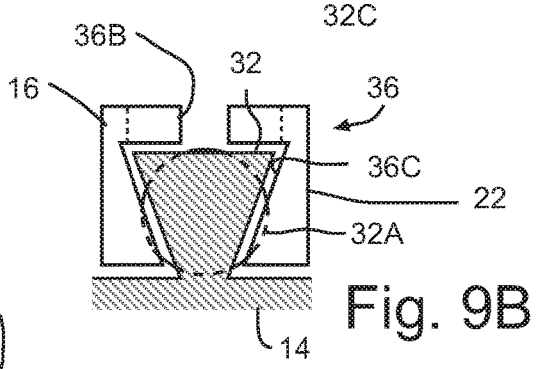
FIG. 9B is a section view taken along section lines 9B of FIG. 9A.

Referring to FIGS. 7, 9, 9A and 9B, socket 36 may be adapted to permit slide-and-swing motion. Socket 36 may permit sliding of rail bar 32 through guide channel 36C into the intermediate position shown by solid lines in FIG. 9A. Referring to FIG. 9B, guide channel 36C is structured to retain and prevent the passage of pivot part 32A, to prevent roller assembly 14 being over slid out of the socket 36. Guide channel 36C and rail bar 32 may have complimentary cross-sectional shapes, for example different-sized trapezoids, with the channel 36C structured to provide sufficient clearance to permit free sliding of rail bar 32 through channel 36C. Referring to FIGS. 9A and 9B, socket 36 may form a seat, with flanges 36E positioned to prevent upward pullout of pivot part 32A from socket 36 when in the seated position shown by dashed lines in FIG. 9A. Referring to FIGS. 9 and 9A, socket 36 may define open sections 36A and 36B that are shaped to pass pivot part 32A and neck 32B, respectively. Thus, from the position shown in dashed lines roller assembly 14 may be removed by moving assembly 14 towards the front end 12C of shoe 12 until sections 36A and 36B are aligned with part 32A and neck 32B, respectively. The assembly 14 may then be moved in direction 46 to separate rail bar 32 from guiding part 16 and socket 36.

Referring to FIG. 10, roller assembly 14 may be swung upward from the intermediate position and locked in a stowed position as shown. When in the stowed position the user may rotate the handle 18 down, such that lock receiving part 38 engages hook 26. Hook 26 and pivot part 32A are stopped from movement in opposing directions by hook receiving part 38 and socket 36, respectively, retaining the assembly 14 in the stowed position.

Figure 12:
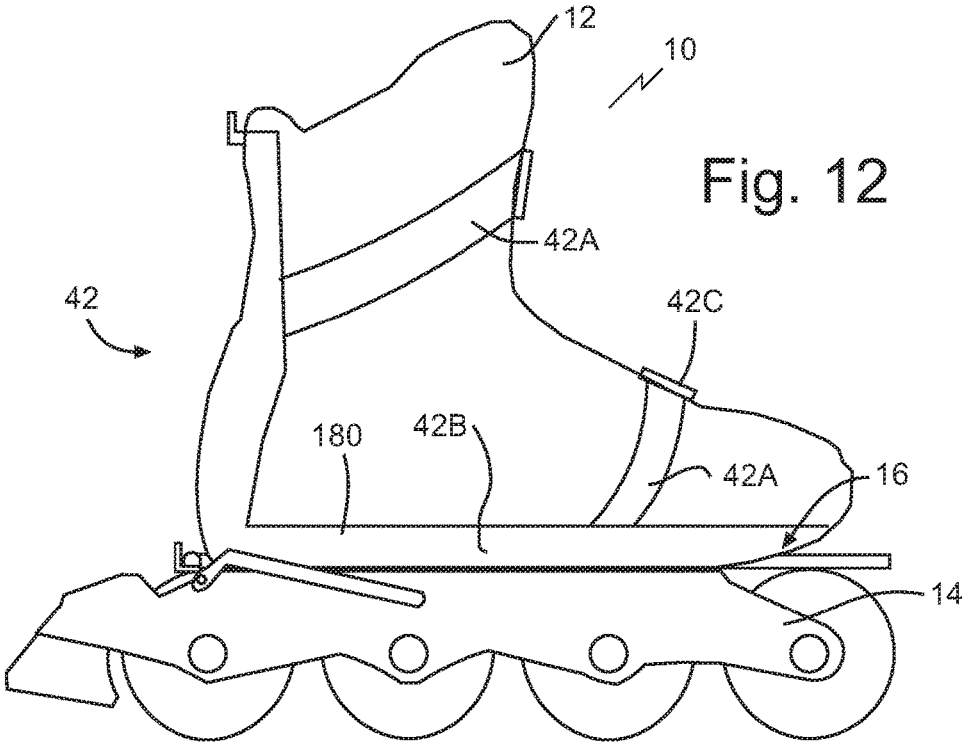
FIG. 12 is a side elevation view of an embodiment of a roller skate with a guiding part retrofitted to a shoe.

Referring to FIG. 12, an embodiment of a roller skate 10 is illustrated with a guiding part 16, for example that incorporates a structural frame 180, that is adapted to fit to, and be removed from, a shoe. Collectively, roller assembly 14 and guiding part 16, including in some cases frame 180, may form a unit 42 that is structured to retrofit to shoe 12. Unit 42 may comprise straps 42A for binding to shoe 12. Straps 42A may comprise buckles 42C for providing an adjustable fit to shoe 12. In some cases, shoes 12 is a conventional walking shoe, skate shoe or cowboy boot. Other suitable mechanisms may be used to secure the guiding part 16 to shoe 12, such as clip on mechanisms, hook and look fasteners, and others. The guiding part 16 may be configured to be adjustable in size, for example in length if a part of the guiding part 16 can extend or retract. Part 16 may be adjustable in length with a screw and bar for example. Part 16 may be divided into two parts front and back and that are connected with a bar and screw method for example.

Figure 13:
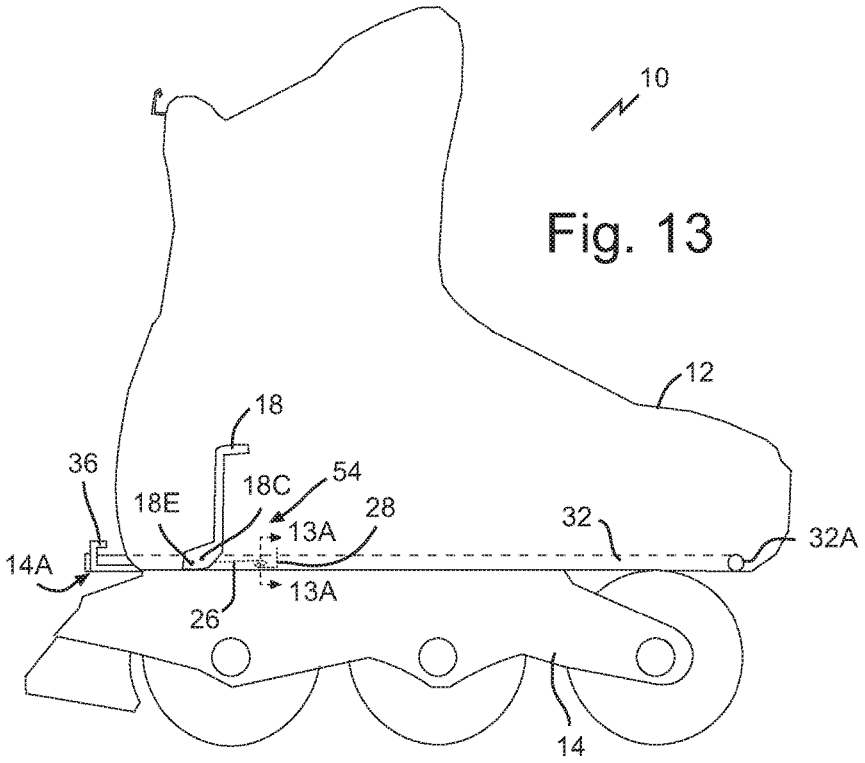
FIG. 13 is a side elevation view of an embodiment of a roller skate with a camlock locking the roller assembly in the deployed position.
Figure 13A:
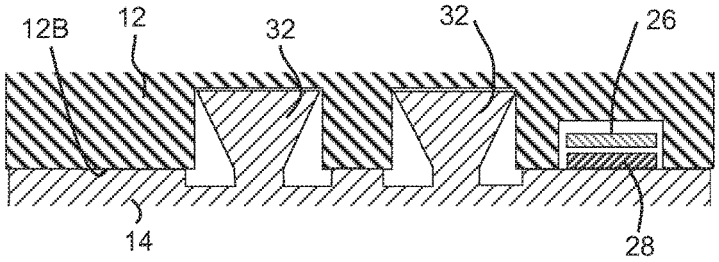
FIG. 13A is a section view taken along section lines 13A of FIG. 13.
Figure 13B:
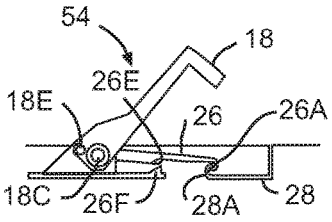
FIGS. 13B-D are a series of side elevation views of an embodiment of the camlock shown in a locked position, intermediate, and unlocked position.
Figure 13C:
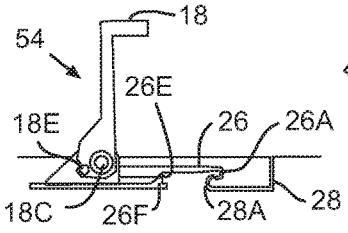
Figure 13D:
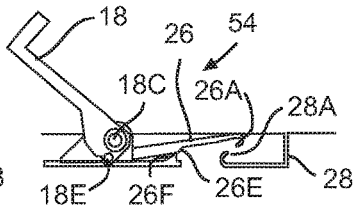
Figure 14:
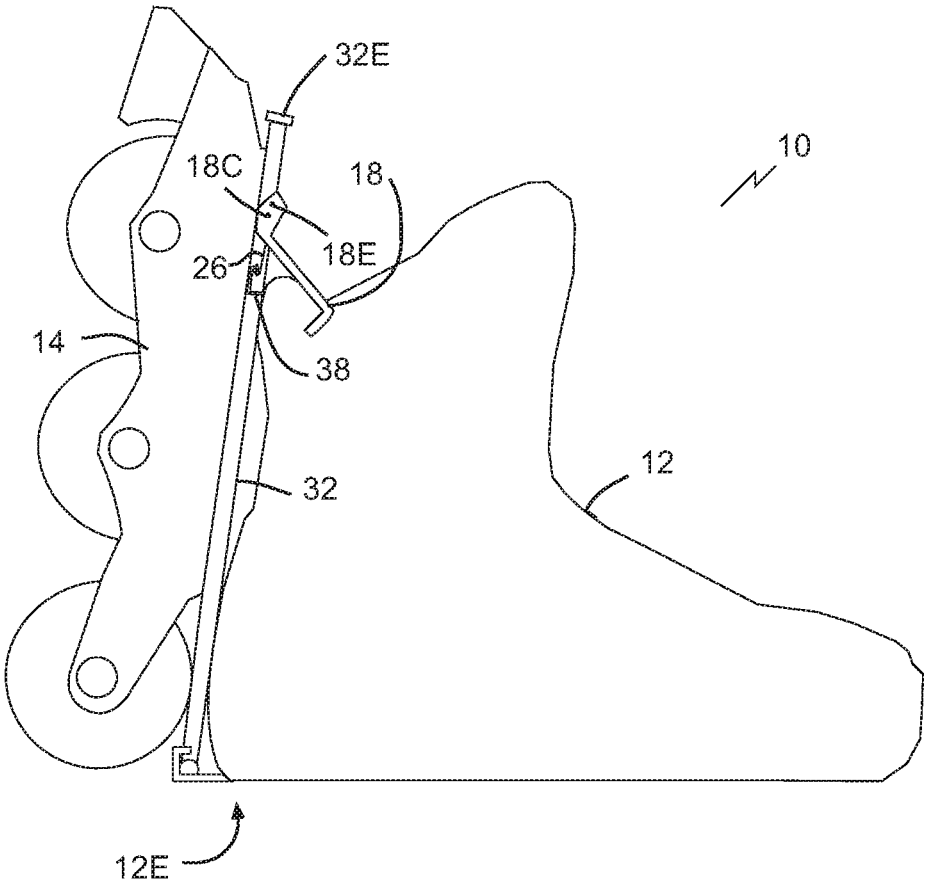
FIG. 14 is a side elevation view of the roller skate of FIG. 13 illustrating the roller assembly locked in the stowed position.

Referring to FIGS. 13, 13B-13D, 14, and 15, a further embodiment of a skate 10 is illustrated that is structured for slide and swing operation. Referring to FIG. 13, skate 10 may comprise a camlock 54 for locking and unlocking the roller assembly 14 to guiding part 16 and/or shoe 12 when in the deployed position. Handle 18 may form a lever with pivot axles 18C and 18E that connect handle 18 to roller assembly 14 and hook 26, respectively. Referring to FIGS. 13B, 13C and 13D, hook 26 and cavity 28A may engage when the camlock 54 is in the locked position, for example when the handle 18 is pushed forward and hook 26 and cavity 28A are under tension. When the handle 18 is swung rearward to unlock the hook 26 and cavity 28A, a cam surface 26E of hook 26 may contact a part, such as a ramp 26F, that moves the hook 26 out of the path of the part 28A to prevent the hook 26, cavity 28A from engaging with one another during movement of assembly 14. Referring to FIG. 13A, rail bar 32 may comprise a plurality of rail bars 32, and in some cases a plurality of corresponding sockets 36 (not shown) to accommodate same. Referring to FIG. 14, once the assembly 14 is in the stowed position, the handle 18 may be operated to allow the camlock 54 to engage and lock assembly 14 to part 38. Part 38 may be 38 adjustable in position, for example by sliding up or down along a track on the shoe, and may have a part that permits part 38 to be secured in a selected position for example by screwing two plates together. Other methods of making part 38 adjustable may be used.

Referring to FIG. 13, bar 32A may be engaged by a stop that prevents the bar 32 from over sliding to the front of the shoe 12. In some cases the stop may form a shelf that underlies the part 32A in the deployed position to prevent unwanted swinging out of deployed. The stop may be made of metal or other suitable material. A hook may be used as a stop.

Figure 16:
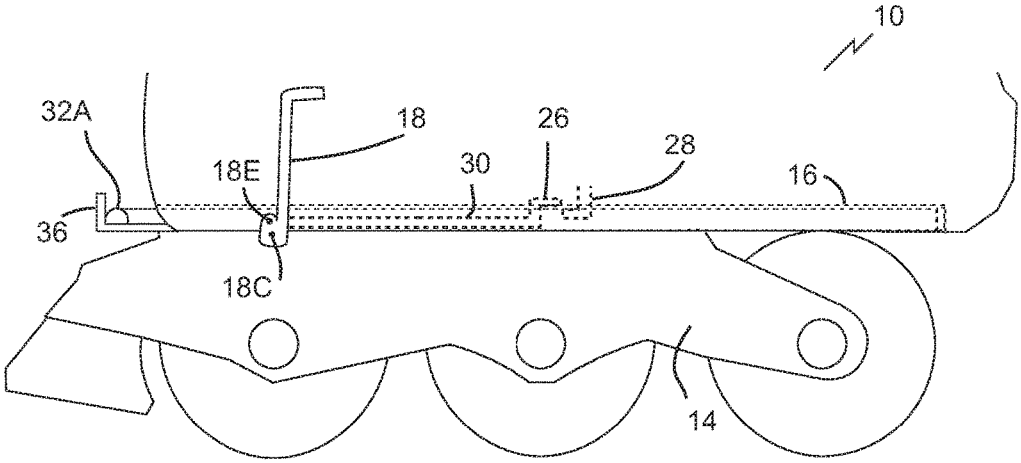
FIG. 16 is a side elevation view of the roller skate of FIG. 15 illustrating the roller assembly unlocked in the deployed position.
Figure 17:
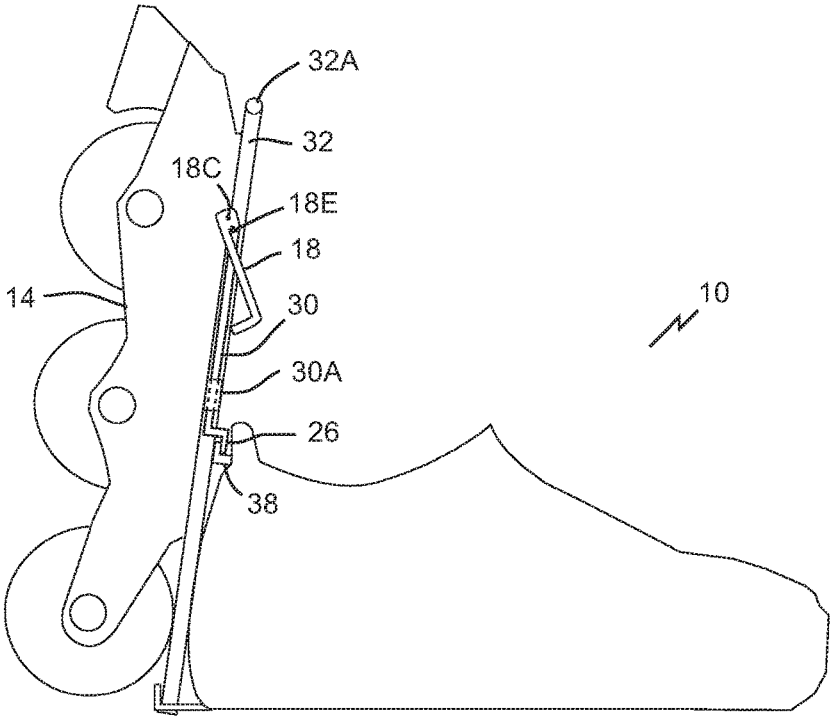
FIG. 17 is a side elevation view of the roller skate of FIG. 15 illustrating the roller assembly locked in the stowed position, with a low cut shoe.

Referring to FIGS. 15, 16 and 17, a further embodiment of a roller skate 10 for swing and slide operation is illustrated. The locking part may comprise a drive bar 30 with a rigid or integral hook 26 to lock assembly 14 to shoe 12 in the stowed and deployed positions. Rotation of the handle 18 causes the drive bar 30 and hook 26 to extend and retract to lock and unlock the assembly in the deployed position. Referring to FIGS. 15A, 15B1 and FIG. 15B2, additional locking parts may be used. Referring to FIGS. 15A and 15B1, in one case a locking part may comprise a male part 18F that engages with a corresponding female part 34E when lever lock 18A is pushed into the shoe, forming a lever lock that prevents rotation of the handle 18. Referring to FIG. 15B2, a locking part may comprise a male part 18F that is laterally extended into female part 34E when bar 30 is extended and cam surfaces 18G and 18H cooperate to overcome the biasing force of a spring 34B held by a spring retainer 34C. On retraction of bar 30, the male part 18F retracts via spring force to unlock the locking part shown. Referring to FIG. 17, once unlocked the assembly 14 may be moved into the stowed position and locked, for example using hook 26 and bar 30, which may be retained against assembly 14 via a retainer, such as sleeve 30A.

Figure 18A:
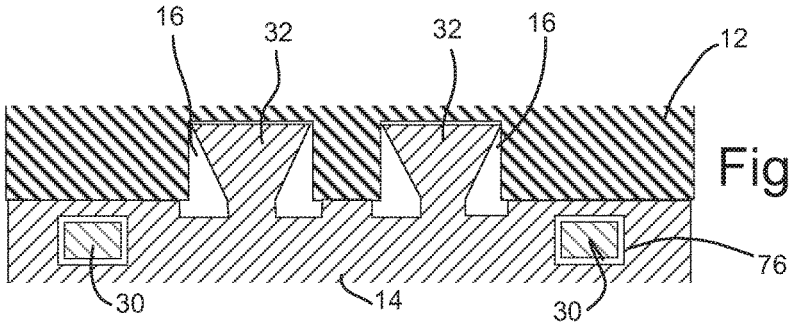
FIG. 18A is a section view taken along section lines 18A of FIG. 18.
Figure 18B:
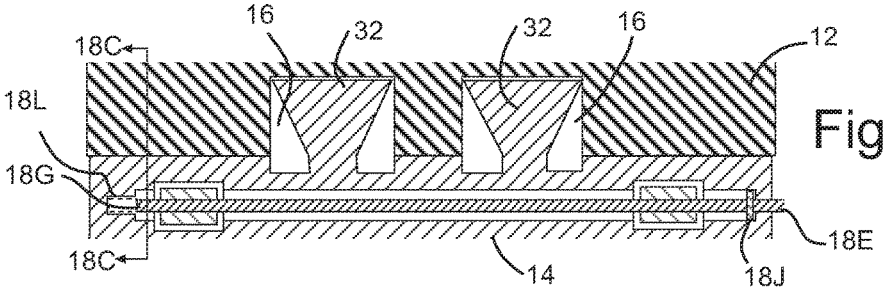
FIG. 18B is a section view taken along section lines 18B of FIG. 18.
Figure 18C:
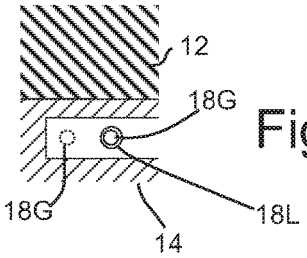
FIG. 18C is a section view taken along section lines 18C of FIG. 18B.
Figure 19:
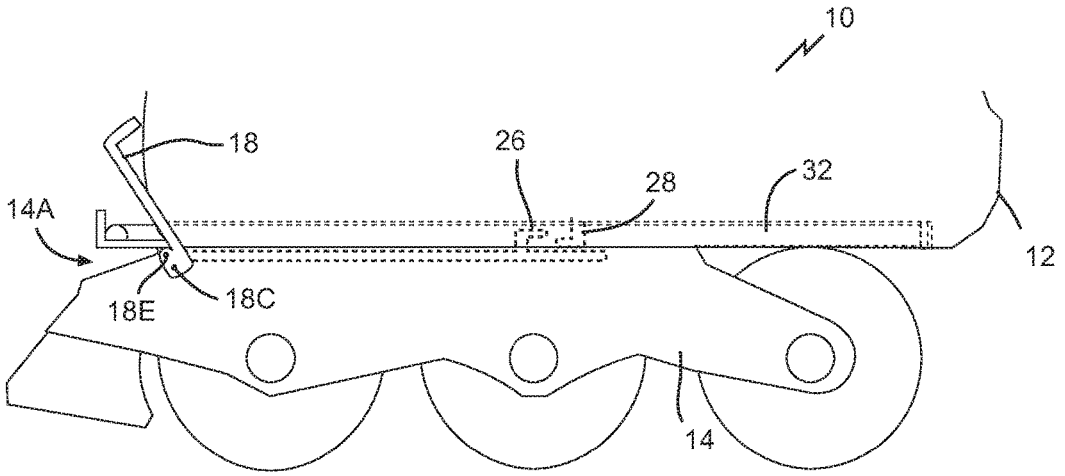
FIG. 19 is a side elevation view of the roller skate in FIG. 18 illustrating the roller assembly unlocked in the deployed position.
Figure 20:
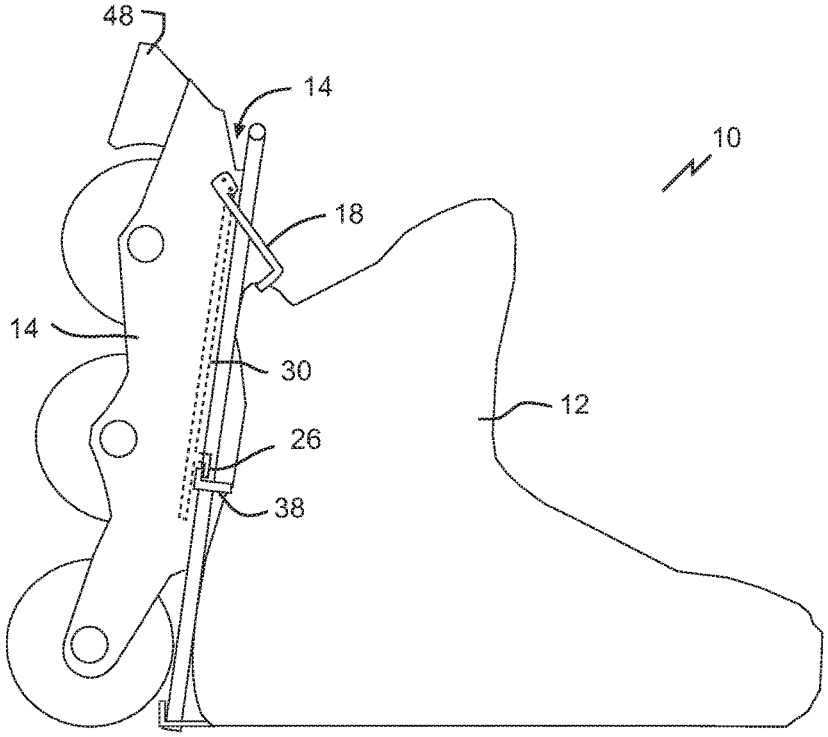
FIG. 20 is a side elevation view of the roller skate in FIG. 18 illustrating the roller assembly locked in the stowed position.

Referring to FIGS. 18, 19 and 20, a further embodiment of a roller skate 10 is illustrated for slide and swing operation. Referring to FIG. 18, the handle 18 may be used to lock and unlock the hook 26 from the deployed position. Referring to FIG. 18A, guide bar 30 may comprise a plurality of guide bars 30, each operated by the same handle 18 (this is the embodiment shown) or a different handle 18, for example one handle 18 on either side of the roller assembly (not shown). Each bar 30 may have an end 30B that extends and retracts into a slot 76 in the guiding part 16, in addition to the locking action of hooks 26. Referring to FIGS. 18B and 18C, a lever lock may be used, for example, when bar 30 is extended, axle 18E may align with a female part 18L, and upon inserting axle 18E into female part 18L the rotation of the handle 18 becomes locked in place. A stop 18J on axle 18E may limit pull out of axle 18E when releasing the lever lock. Referring to FIGS. 19 and 20, after unlocking the assembly 14, the assembly may be swung and slid into the stowed position, and locked by rotating the handle 18 down to engage hook 26 with part 38 on the rear of the shoe 12.

Figures 24, 25, 26, 27, 28, 29:
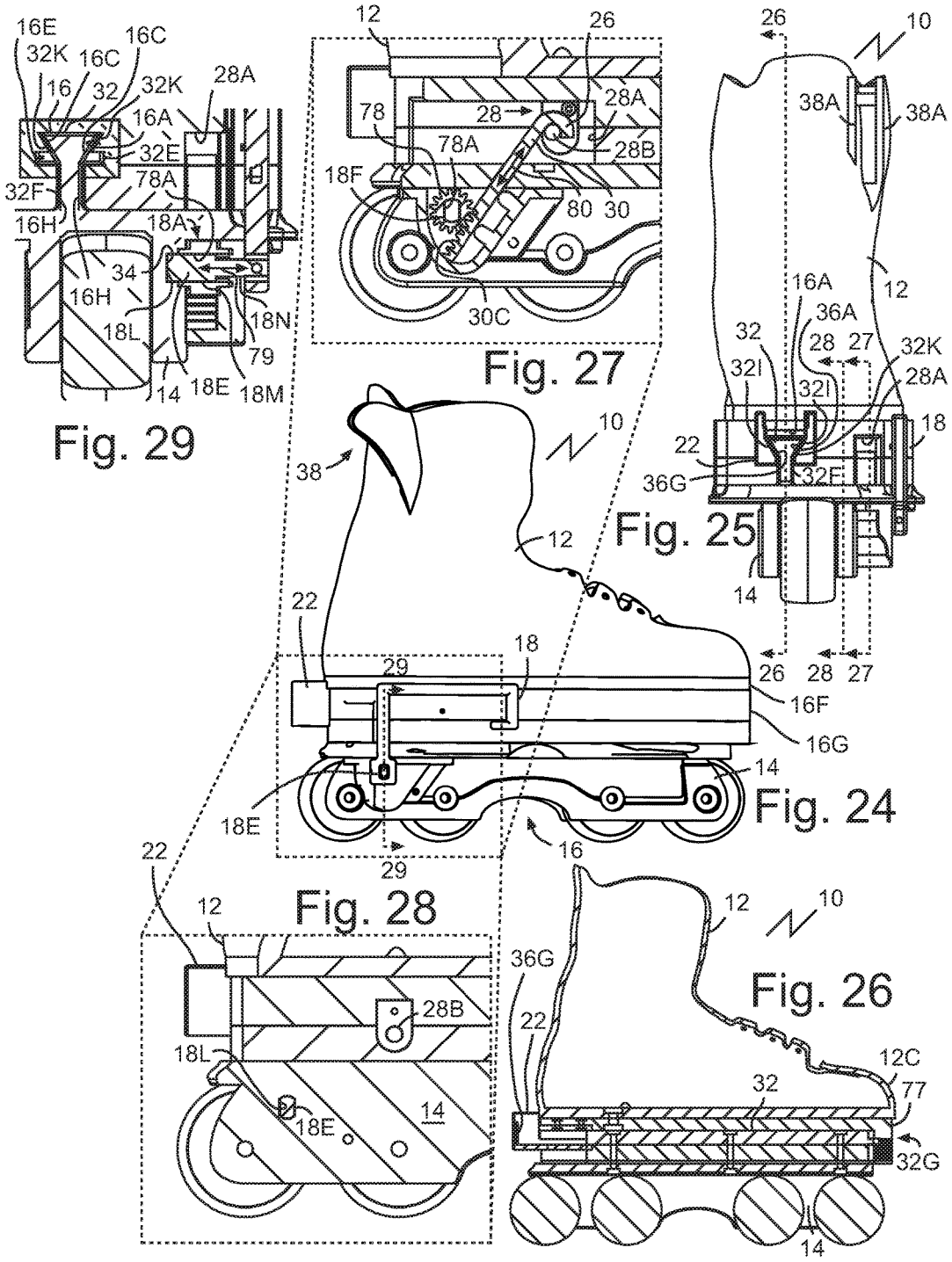
FIG. 24 is a side elevation view of another embodiment of a roller skate with a roller assembly locked in the deployed position, and configured to move between the deployed position and a stowed position via a slide and swing maneuver.
FIG. 25 is a rear end view of the roller skate of FIG. 24.
FIG. 26 is a section view taken along the 26-26 section lines of FIG. 25.
FIG. 27 is a section view taken along the 27-27 section lines of FIG. 25 and illustrating the area shown in dashed lines in FIG. 24.
FIG. 28 is a section view taken along the 28-28 section lines of FIG. 25 and illustrating the area shown in dashed lines in FIG. 24.
FIG. 29 is a section view taken along the 29-29 section lines of FIG. 24.

Referring to FIGS. 24-40 a further embodiment of a roller skate 10 adapted for slide and swing operation is illustrated. Referring to FIGS. 24-29, the handle 18 may be used to lock and unlock the hook 26 from the deployed position, and to lock and unlock a lever lock 18A. Referring to FIGS. 24 and 27-29, the handle 18 may rotate an axle 18E, which passes through a bore 78A in a pinion 78, which is mounted to advance and retract a drive bar 30 whose end defines a hook 26. The axle 18E has an out-of-round cross-sectional profile that aligns, at least when the handle is rotated to lock the skate 10 in the deployed position, with a correspondingly shaped female part 18L in the roller assembly 14. As shown, the part 18L and axle 18E are aligned, and the axle 18E has been inserted into the part 18L to lock the handle 18 from rotation. In some cases the part 18L and axle 18E only align when the hook 26 engages the part 28B, in this case a bar, meaning that the handle 18 has locked the roller assembly 14 in the deployed position. Referring to FIG. 29, for the user to unlock the lever lock 18A, the handle 18 and hence the axle 18E are translated along translation axis 79 away from the shoe 12, to remove axle 18E from engagement with female part 18L. Referring to FIGS. 29 and 38-40, the axle 18E may be structured to facilitate insertion and removal from part 18L without coming apart from the roller assembly 14. In the example shown the axle 18E has a relative wide part 18M and a relatively narrow part 18N, both situated in a pinion bore 78A dimensioned to accommodate the relatively wide part 18M, such that the axle 18E may be slid along translation axis 79 within bore 78A. Pinion 78 and axle 18E may be held in place within roller assembly 14 via a part, such as cover 92, which secures the parts to the roller assembly 14. A nut 90 or other suitable part may connect the handle 18 and axle 18E.

Figure 38:
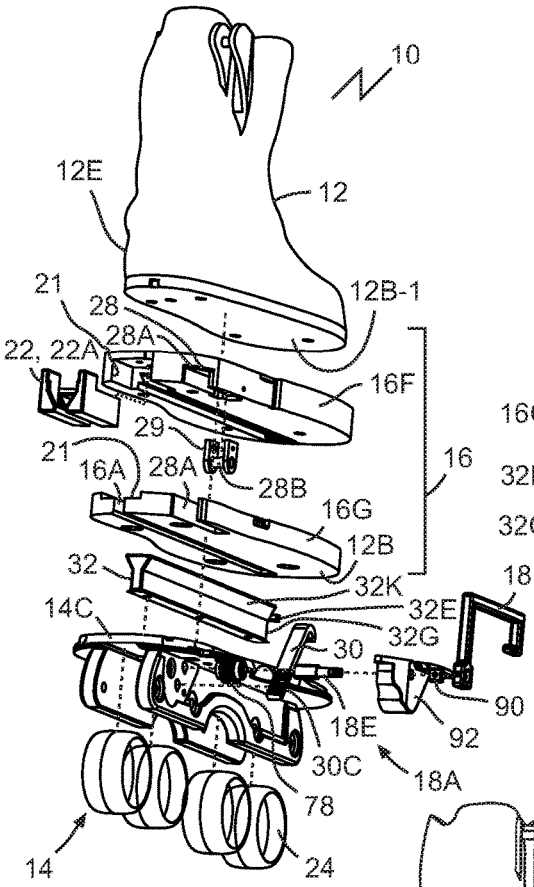
FIG. 38 is an exploded perspective view of the roller skate of FIG. 24.
Figure 39:
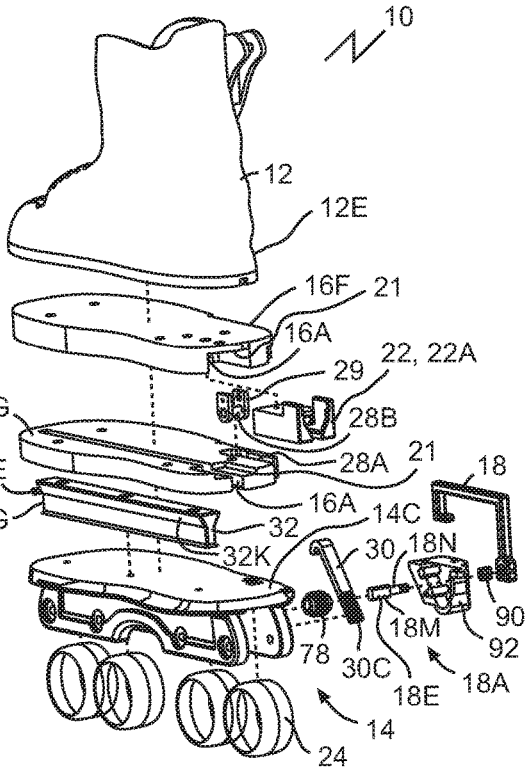
FIG. 39 is another exploded perspective view of the roller skate of FIG. 24.
Figure 40:
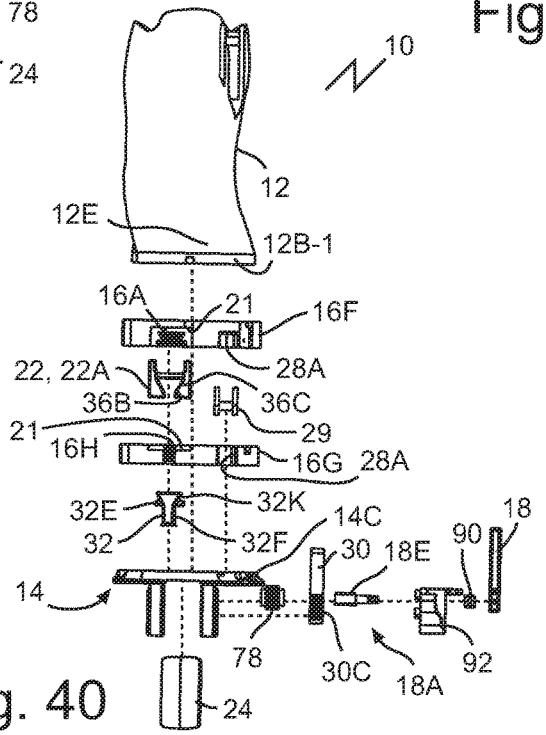
FIG. 40 is an exploded rear end view of the roller skate of FIG. 24.

Referring to FIG. 27, once the axle 18E is withdrawn from part 18L, the roller assembly 14 may be unlocked from the deployed position shown. To unlock, the user rotates handle 18 in a counter clockwise fashion, to rotate pinion 78, which engages rack 30A of bar 30 to advance bar 30 along translation axis 80, and to move hook 26 out of engagement with bar or other hook engaging part 28B. Referring to FIGS. 38-40, the part 28B may be mounted on an insert 29 that mounts to the shoe 12. In the example shown the shoe 12 mounts one or more plates, such as plates 14C, 16F and 16G, which collectively produce the guiding part 16 that guides the roller assembly 14. The shoe 12 itself may secure mounting plate 14C structured to mount the plate or plates 16F and 16G. The plates may have fastener holes or other mechanisms to align with and secure the other plates. In the example shown the insert 29 may fit within a respective cavity 28A or cavities 28A defined by the plate or plates 16F and 16G. The cavity 28A opens to the rear end 12E of the shoe to allow the hook 26 to enter the cavity by advancing toward the front of the shoe 12, and to allow the hook 26 to exit the shoe 12 by advancing toward the rear end 12E of the shoe 12.

Figures 30, 31, 32:
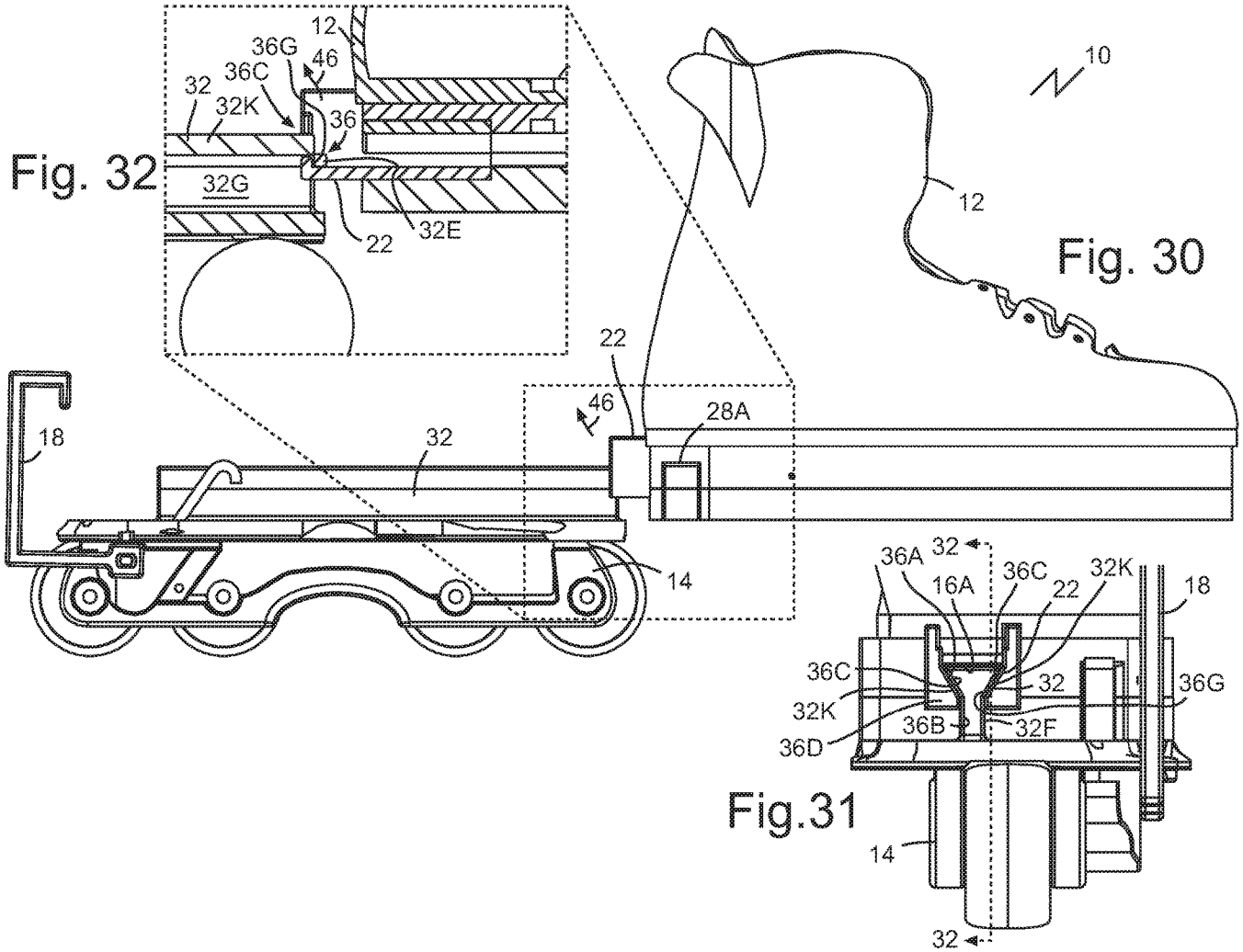
FIG. 30 is a side elevation view of the roller skate of FIG. 24 illustrating the roller assembly at an intermediate position between the deployed and stowed positions.
FIG. 31 is a rear end view of a bottom portion of the roller skate of FIG. 30.
FIG. 32 is a section view taken along the 32-32 section lines of FIG. 31 and illustrating the area shown in dashed lines in FIG. 30.

Referring to FIGS. 24-26 and 30-32, the roller assembly 14 may move by a suitable mechanism out of the deployed position toward the stowed position. A rail bar 32 of assembly 14 may be adapted to slide along the guiding part, for example through a guide channel 36C defined by base walls 36G of socket 36. Referring to FIGS. 25, 29, 31, and 38-40, the rail bar 32 may have a cross-sectional shape that corresponds with the cross-sectional shape of a slot 16A defined in the guiding part 16, in this case in plates 16F and 16G. Referring to FIGS. 25, 29, and 31, the bar 32 may have one or more flanges 32K, which in the example shown collectively define a trapezoidal shape as shown, which are shaped to permit translation within slot 16A, in this case within a flange-receiving slot defined by tapered side walls 16C, which restrict the bar 32 from being removed by pulling the bar 32 in a downward direction away from the shoe 12 in the images shown. The flanges 32K may extend in lateral directions relative to a neck 32F, which is relatively narrower in cross-sectional width than the flanges 32K, and which is received by a neck-receiving slot 16H.

Referring to FIGS. 25 and 31, the hinge 22 may be shaped to permit translation of the bar 32 into and out of the slot 16A as shown. The rail bar 32 may be adapted to slide along the guiding part, for example through a guide channel 36C defined by base walls 36G of socket 36. A first section 36B and second section 36A may be defined by walls 36D as before, to pass neck 32F and flanges 32K, respectively. Referring to FIGS. 29, 32, and 38-40, bar 32 may mount, for example at front end 32G of bar 32, a bar or other stop 32E, which in the example shown is a bar whose ends extend laterally beyond the cross-sectional profile of the neck 32F and flanges 32K. The slot 16A may have a correspondingly shaped stop slot 16E structured to permit the stop 32E to translate with the bar 32. Referring to FIG. 32, when the bar 32 exits slot 16A as shown, the stop 32E contacts walls 36G of socket 36, restricting further translation. However, at this point the user may remove the roller assembly 14 from the skate 10 by moving the stop 32E out of hinge 22 via a movement in direction 46. Movement into the intermediate position may be accomplished by a user applying force to handle 18 to translate the assembly 14.

Referring to FIGS. 33-37, from the intermediate position of FIG. 30 the roller assembly 14 may be guided into a stowed position shown. The handle 18 may be used to swing the roller assembly up about hinge 22, with stop 32E acting as a pivot point. Referring to FIG. 36, the stop 32E may remain seated against walls 36G of socket 36 during such movement. If desired the assembly 14 may be removed from the shoe 12 via movement in a direction 46 even in the position shown in FIG. 36. Referring to FIG. 37, an image is shown that illustrates how the stop 32E contacts both walls 36G to retain the stop 32E within the socket 36. Referring to FIGS. 38-40, the hinge 22 may be mounted in a suitable fashion, for example on a hinge insert 22A that fits within a respective slot 21 defined by one or both plates 16F and 16G Referring to FIGS. 33 and 35, once in the stowed position the roller assembly 14 may be locked in the stowed position. The handle 18 may be operated to achieve such a function. By rotating the handle 18, in this case in a clockwise fashion, the hook 26 is advanced along axis 80 to clear the hook receiving part 38, and then by a reverse motion the hook 26 may be retracted to grip the part 38 as shown. Once gripped, the hook 26 prevents the roller assembly 14 from being lifted upward off the shoe 12, and the hinge 22 and socket 36 prevent the assembly 14 from being moved in a downward direction below the shoe 12. Referring to FIGS. 33 and 35, the part 38 may be mounted to shoe 12 in a suitable fashion, such as between adjacent spaced walls 38A. Movement from the locked, stowed position to the locked, deployed position may be carried out by the reverse procedure as discussed above.

Various other features may be incorporated in skate 10. Referring to FIGS. 24 and 26, perforations 77 or other pressure release parts may be provided to facilitate smooth movement of bar 32 through slot 16A without restrictive pressure buildup.

Figure 21:
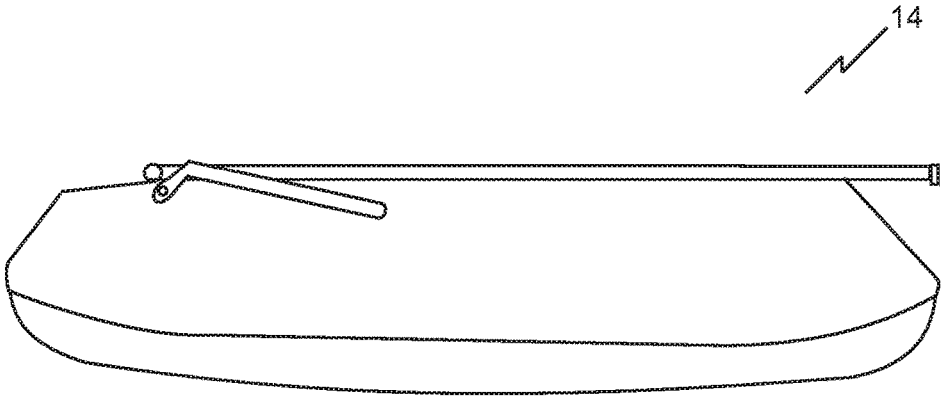
FIGS. 21-23 are side elevation views of a blade assembly, a track assembly, and a ski assembly, respectively.
Figure 22:
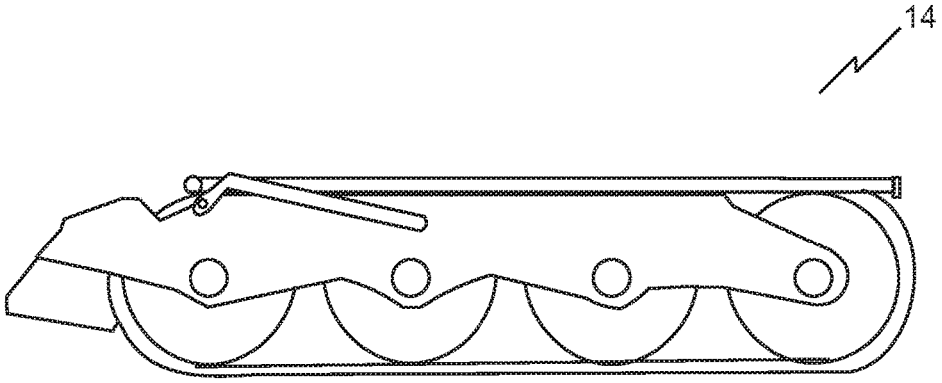
Figure 23:
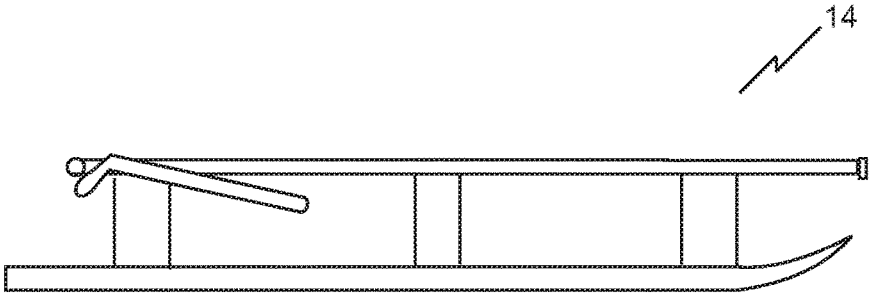

Referring to FIGS. 21-23 the roller assembly 14 may be replaced with a corresponding blade, a track, or a ski assembly 14, respectively. A ski assembly may include a board. The meaning of terms such as down, up, top, base, and others is relative to other parts and not restricted to absolute orientations relative to the direction of gravitational acceleration on the Earth unless context dictates otherwise. Instead of or in addition to a slot 16A (FIG. 1A), a protrusion may be present on the guiding part 16 for engaging a corresponding slot on the roller assembly. The handle 18 may be detachable, foldable, and/or stowable. Axles may incorporate pins, hubs, bushings and other parts. The guiding part, any all other items referred to with the word part, may each comprise plural parts that make up the respective part. The skates disclosed here may be motorized, for example if a motor is connected to drive each skate. Locking may mean preventing the assembly 14 from releasing away from the shoe in the deployed position, or from releasing away from the back of the shoe from the stowed position. Locking may include preventing the assembly 14 from all forms of relative movement with the shoe, for example rotating, axial sliding, swinging, or shifting. References to parts being on the shoe may include such parts being on the guiding part, for example if a part of the roller assembly 14 is stated as being connected to the shoe, the connection may be made directly between the assembly 14 and the guiding part 16, which is connected directly to the shoe.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method comprising:

unlocking a roller, blade, ski, or track assembly from a deployed position on a shoe, in which a handle is connected to the roller, blade, ski, or track assembly;

applying a force to the handle to move the roller, blade, ski, or track assembly, via the force, along a guiding part into a stowed position adjacent a calf or ankle part of the shoe;

locking the roller, blade, ski, or track assembly to the shoe in the stowed position;

in which the roller, blade, ski, or track assembly is one or more of unlocked from the deployed position or locked in the stowed position using the handle;

in which the handle forms a lever that is connected to lock and unlock the roller, blade, ski, or track assembly in the deployed position;

in which the lever is connected to pivot relative to the roller, blade, ski, or track assembly to lock and unlock the roller, blade, ski, or track assembly in the deployed position; and in which the lever is connected to actuate a locking part that engages and disengages a locking part receiver of the guiding part to lock and unlock, respectively, the roller, blade, ski, or track assembly in the deployed position.

2. The method of claim 1 in which unlocking the roller, blade, ski, or track assembly from the deployed position is accomplished using the handle.

3. The method of claim 1 in which locking the roller, blade, ski, or track assembly in the stowed position is accomplished using the handle.

4. The method of claim 1 in which the handle comprises the lever pivotally mounted to the roller, blade, ski, or track assembly.

5. The method of claim 1 further comprising:

unlocking the roller, blade, ski, or track assembly from the stowed position;

operating the handle to move the roller, blade, ski, or track assembly along the guiding part into the deployed position; and locking the roller, blade, ski, or track assembly to the shoe in the deployed position.

6. The method of claim 5 in which unlocking the roller, blade, ski, or track assembly from the stowed position is accomplished using the handle.

7. The method of claim 5 in which locking the roller, blade, ski, or track assembly in the deployed position is accomplished using the handle.

8. The method of claim 1 in which the handle is located at or near a rear end of the roller, blade, ski, or track assembly.

9. The method of claim 1 in which the lever and locking part form a camlock.

10. The method of claim 1 in which the lever is located adjacent a side of the shoe and connected to:

actuate the locking part when the lever is swung toward or away from a front of the shoe; and actuate a lever lock, between the lever and one or both of the roller, blade, ski, or track assembly and shoe, by translating the lever toward or away from the side of the shoe.

11. The method of claim 10 in which the lever lock is formed by cooperating male and female parts on the roller, blade, ski, or track assembly and shoe.

12. The method of claim 1 in which the lever is connected to actuate the locking part to engage and disengage a locking part receiver of the calf or ankle part of the shoe to lock and unlock, respectively, the roller, blade, ski, or track assembly in the stowed position.

13. The method of claim 1 in which the guiding part comprises a hinge located at a rear end of the shoe.

14. The method of claim 13 in which the roller, blade, ski, or track assembly is mounted to, in sequence:

slide rearward along the guiding part, relative to the shoe, from the deployed position; and swing upward about the hinge, relative to the shoe, into the stowed position.

15. The method of claim 13 in which the hinge one or more of:

forms a socket that during use seats a pivot part of the roller, blade, ski, or track assembly; or defines a guide channel through which a part of the roller, blade, ski, or track assembly slides.

16. The method of claim 1 in which one or more of:

the guiding part is structured to permit the roller, blade, ski, or track assembly to be removed; or the roller, blade, ski, or track assembly and guiding part form a unit that is structured to retrofit to the shoe.

17. The method of claim 1 forming an inline skate.

* * * * *